US009533331B1

(12) United States Patent
Kane et al.

(10) Patent No.: US 9,533,331 B1
(45) Date of Patent: Jan. 3, 2017

(54) HAND-HELD SOLID CHEMICAL APPLICATOR

(71) Applicant: Crossford International, LLC, Stamford, CT (US)

(72) Inventors: Timothy J. Kane, Stamford, CT (US); Joseph J. Franzino, Stamford, CT (US); Ray Field, Stamford, CT (US)

(73) Assignee: Crossford International, LLC, Stamford, CT (US)

( * ) Notice: Subject to any disclaimer, the term of this patent is extended or adjusted under 35 U.S.C. 154(b) by 0 days.

(21) Appl. No.: 14/925,213

(22) Filed: Oct. 28, 2015

(51) Int. Cl.

| | |
|---|---|
| ***B05B 7/00*** | (2006.01) |
| ***B08B 3/08*** | (2006.01) |
| ***B08B 3/02*** | (2006.01) |
| ***B05B 7/24*** | (2006.01) |

(52) U.S. Cl.
CPC ..... *B08B 3/08* (2013.01); *B05B 7/2462* (2013.01); *B08B 3/026* (2013.01)

(58) Field of Classification Search
CPC ..... B08B 3/08
See application file for complete search history.

(56) References Cited

U.S. PATENT DOCUMENTS

| | | | |
|---|---|---|---|
| 4,628,644 | A | 12/1986 | Somers |
| 5,560,545 | A | 10/1996 | Grogan et al. |
| 5,819,987 | A | 10/1998 | Miller |
| 5,884,820 | A | 3/1999 | Thanisch et al. |
| 6,116,472 | A | 9/2000 | Wanbaugh et al. |
| 6,234,412 | B1 | 5/2001 | Von Schuckmann |
| 6,471,141 | B2 | 10/2002 | Smith et al. |
| 6,641,003 | B1 | 11/2003 | Foster et al. |
| 6,669,061 | B2 | 12/2003 | Tada |
| 6,726,123 | B2 | 4/2004 | Wang |
| 6,729,560 | B2 | 5/2004 | Foster et al. |
| 6,752,330 | B2 | 6/2004 | Dimaggio et al. |
| 6,910,605 | B2 | 6/2005 | Schuckmann et al. |
| 7,028,916 | B2 | 4/2006 | Micheli |
| 7,328,859 | B2 | 2/2008 | Hornsby et al. |
| 7,407,117 | B2 | 8/2008 | Dodd |
| 7,445,167 | B1 | 11/2008 | Chen |
| 7,464,887 | B2 | 12/2008 | Lo |
| 7,490,783 | B2 | 2/2009 | Mueller et al. |
| 7,775,405 | B2 | 8/2010 | Sweeton et al. |
| 7,967,171 | B2 | 6/2011 | Foster et al. |
| 7,997,449 | B2 | 8/2011 | Banco et al. |

(Continued)

FOREIGN PATENT DOCUMENTS

| | | |
|---|---|---|
| RU | 2333714 | 9/2008 |

OTHER PUBLICATIONS

Written Opinion for PCT/US2015/057758 dated Jun. 30, 2016; 4 pps.

(Continued)

*Primary Examiner* — Michael Barr
*Assistant Examiner* — Jason Riggleman
(74) *Attorney, Agent, or Firm* — Carson C. K. Fincham; Fincham Downs, LLC

(57) ABSTRACT

Hand-held solid chemical applicator assemblies for various cleaning applications such as coil cleaning utilizing specially-configured chemical tablet chamber and assembly hydraulics. In some cases, the hand-held solid chemical applicator assemblies are configured to include a cylindrical flow diverter to facilitate proper chemical tablet dissolution.

17 Claims, 10 Drawing Sheets

(56) References Cited

U.S. PATENT DOCUMENTS

| | | | |
|---|---|---|---|
| 8,066,155 | B2 | 11/2011 | Tada |
| 8,069,878 | B2 | 12/2011 | Laible |
| 8,104,646 | B2 | 1/2012 | Foster et al. |
| 8,136,698 | B1 * | 3/2012 | Beaulieu ..... B05B 7/0408 222/105 |
| 8,177,143 | B2 | 5/2012 | Laible |
| 8,235,310 | B2 | 8/2012 | Birrenkott et al. |
| 8,281,960 | B1 | 10/2012 | Gers |
| 8,469,291 | B2 | 6/2013 | Foster et al. |
| 8,714,415 | B2 | 5/2014 | Rech et al. |
| 8,733,342 | B2 | 5/2014 | Giroux et al. |
| 8,800,822 | B2 | 8/2014 | Good et al. |
| 8,800,823 | B2 | 8/2014 | Sweeton |
| 8,839,991 | B2 | 9/2014 | Smernoff |
| 8,840,045 | B2 | 9/2014 | Thurin et al. |
| 2002/0185420 | A1 | 12/2002 | Horstman et al. |
| 2003/0034051 | A1 | 2/2003 | Barger et al. |
| 2010/0133358 | A1 | 6/2010 | Goehring |
| 2011/0147419 | A1 | 6/2011 | Tada et al. |
| 2011/0253805 | A1 | 10/2011 | Lee |
| 2012/0255973 | A1 | 10/2012 | Schlueter et al. |
| 2013/0008923 | A1 | 1/2013 | Syson et al. |
| 2013/0161359 | A1 | 6/2013 | Alluigi et al. |
| 2013/0220316 | A1 | 8/2013 | Oglesby et al. |
| 2014/0061233 | A1 | 3/2014 | Lang et al. |
| 2014/0239018 | A1 | 8/2014 | Maas et al. |

OTHER PUBLICATIONS

International Search Report for PCT/US2015/057758 dated Jun. 30, 2016; 2 pps.

* cited by examiner

HAND-HELD SOLID CHEMICAL APPLICATOR

BACKGROUND

Heating, Ventilating, and Air-Conditioning (HVAC) systems, as well as other heating and cooling applications (e.g., refrigeration), often utilized coils, fins, and other heat-sink devices as part of a system to transfer heat from one environment to another. Many systems include both an evaporative coil (typically located inside a conditioned space) and a condensing coil (typically located in an external environment). Heat transfer and overall coil effectiveness is greatly dependent upon airflow across and through the coils/fins. As dirt and debris (e.g., dust, mold, etc.) accumulate on and within the coils, fins, etc., airflow becomes blocked and the efficiency of the system may be greatly reduced. While various methods for cleaning coils are available, typical professional cleaning often involves utilization of a wheeled cleaning unit that houses water and/or chemical supplies and has an extendable hose or wand that may be used to direct cleaning sprays at or through the coil to be cleaned.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Embodiments presented herein are descriptive of hand-held solid chemical applicator assemblies (and components and/or features thereof). Hand-held solid chemical applicator assemblies may comprise various components, for example, such as specially-arranged internal hydraulics and/or a specially-configured chemical tablet chamber (e.g., including a cylindrical flow diverter to facilitate proper chemical tablet dissolution), as described in detail herein.

II. Hand-Held Solid Chemical Applicator Assemblies

Figure 1A:
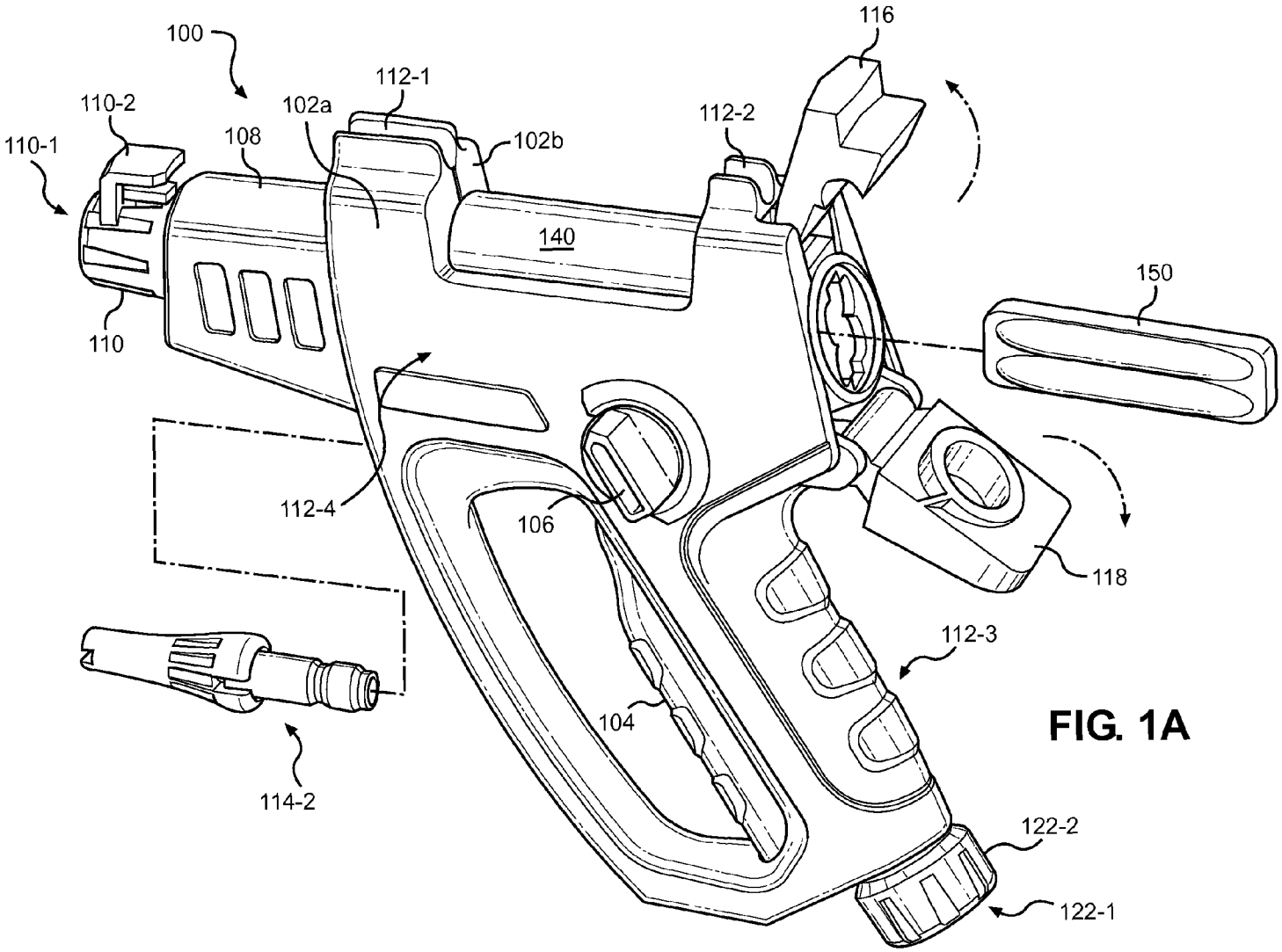
FIG. 1A is an upper, left-rear perspective operational assembly view of a hand-held solid chemical applicator assembly according to some embodiments.
Figure 1B:
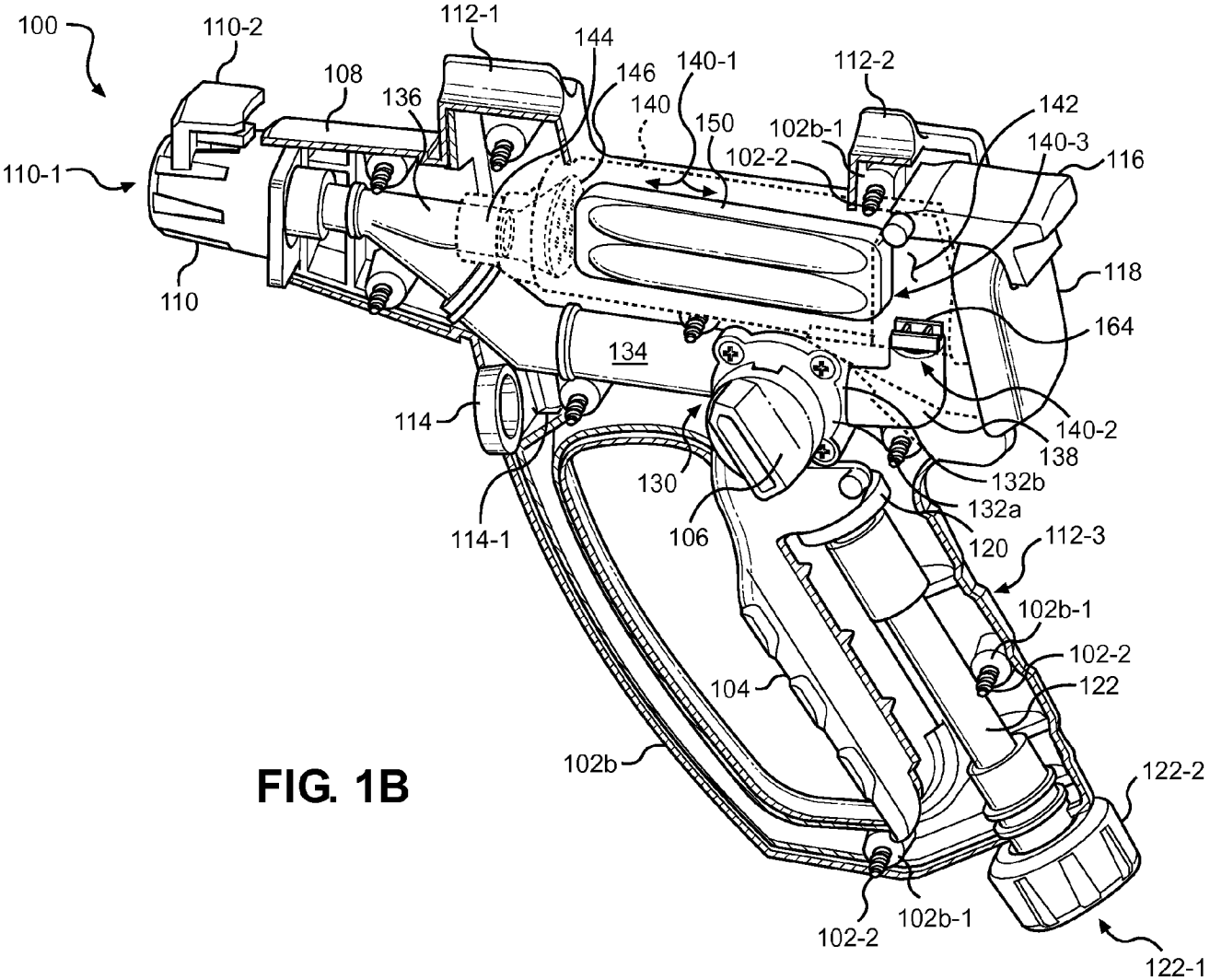
FIG. 1B is an upper, left-rear perspective internal component view of the hand-held solid chemical applicator assembly of FIG. 1A.

Turning initially to FIG. 1A and FIG. 1B, an upper, left-rear perspective operational assembly view, and an upper, left-rear perspective internal component view, respectively, of a hand-held solid chemical applicator assembly 100 according to some embodiments are shown. In some embodiments, the hand-held solid chemical applicator assembly 100 may comprise a housing 102*a-b*. The housing 102*a-b* may comprise, for example, a left housing 102*a* and a right housing 102*b* joined together in any of a variety of fashions. The housing 102*a-b* may be removably assembled, for example, by engaging a plurality of fastening locations 102*b*-1 (shown in FIG. 1B with respect to the right housing 102*b*) with suitable fasteners 102-2 (e.g., screws as shown). In FIG. 1B, the hand-held solid chemical applicator assembly 100 is shown with the left housing 102*b* removed (i.e., not shown), to facilitate view and understanding of the internal components thereof. In some embodiments, the hand-held solid chemical applicator assembly 100 may comprise a plurality of features coupled to and/or housed within the housing 102*a-b*. The hand-held solid chemical applicator assembly 100 may comprise, for example, a trigger 104, a mixing knob 106, a barrel shroud 108, and/or a barrel 110. The trigger 104 may be utilized, as described herein for example, to variably and/or selectively allow fluid to flow into the hand-held solid chemical applicator assembly 100. In some embodiments, the mixing knob 106 may be utilized, as described herein, to variably and/or selectively direct the fluid flow (and/or portions thereof) within the hand-held solid chemical applicator assembly 100. According to some embodiments, the barrel shroud 108 may be coupled to the housing 102*a-b* and the barrel 110 may, in turn, be coupled to the barrel shroud 108.

In some embodiments, the barrel 110 may define and/or comprise a fluid outlet 110-1 and/or may include a retaining clip 110-2. The retaining clip 110-2 may, for example, facilitate removable mounting and/or storage of an extension wand (not shown) to the hand-held solid chemical applicator assembly 100. According to some embodiments, the hand-held solid chemical applicator assembly 100 and/or the housing 102*a-b* thereof may comprise a first wand mount 112-1 and/or a second wand mount 112-2 that are operable (e.g., alone or in combination) to clip onto or otherwise removably accept or couple to an extension wand adaptable to be engaged with the barrel 110 such as to accept fluid exiting the hand-held solid chemical applicator assembly 100 via the fluid outlet 110-1. In such a manner, for example, an extension wand may be attached to the hand-held solid chemical applicator assembly 100 and utilized to clean coils (and/or other objects) and then may be removed from the barrel 110 and clipped onto the hand-held solid chemical applicator assembly 100 via the wand mounts 112-1, 112-2 and selectively retained by the retaining clip 110-2.

According to some embodiments, the hand-held solid chemical applicator assembly 100 and/or the housing 102*a-b* thereof may comprise and/or define a handle portion 112-3 and/or a body portion 112-4. The handle portion 112-3 may, for example, comprise a portion and/or features operable to be grasped by a human hand, such as by including finger grips, a contoured palm surface, and/or other grip features (none of which are separately labeled if shown in FIG. 1A and/or FIG. 1B). As depicted, for example, an operator of the hand-held solid chemical applicator assembly 100 may grasp the handle portion 112-3 such that the operator's fingers are conveniently located to selectively engage with the trigger 104 and, for example, selectively and variably regulate fluid flow into and/or out of the hand-held solid chemical applicator assembly 100 (e.g., out of the fluid outlet 110-1). According to some embodiments (such as depicted), the handle portion 112-3 may be oriented in a vertical position and the body portion 112-4 may be oriented in a horizontal position, e.g., generally defining a "gun" shape of the hand-held solid chemical applicator assembly 100.

In some embodiments, the hand-held solid chemical applicator assembly 100 may comprise a grommet 114, a latch 116, and/or a cap 118. The grommet 114 may, for example, couple to the housing 102*a-b* to govern access to a nozzle storage area 114-1 and/or may accept and/or store a nozzle 114-2 (e.g., which may be coupled, in operation, to one or more of the extension wand (not shown) and the barrel 110). According to some embodiments, the latch 116 and/or the cap 118 may be pivotally coupled to the hand-held solid chemical applicator assembly 100. In some embodiments, the latch 116 and the cap 118 may be hinged and/or pivoted at opposing points such that the latch 116 may engage with and retain the cap 118 in a closed position (as shown in FIG. 1B).

According to some embodiments, the hand-held solid chemical applicator assembly 100 may comprise a first valve 120 (e.g., a variable flow valve) coupled to receive a fluid flow from a fluid inlet conduit 122. The fluid inlet conduit 122 may, for example, comprise and/or define a fluid inlet 122-1 via which fluid flow enters the hand-held solid chemical applicator assembly 100. In some embodiments, such as in the case that the fluid flow originates with a hose or other standardized coupling (not shown), the fluid inlet conduit 122 may be coupled to such an external source via an inlet coupler 122-2. In some embodiments, the first valve 120 may be seated in and/or coupled to the fluid inlet conduit 122 and/or may be selectively engaged with the trigger 104. The trigger 104 may, for example, be squeezed by an operator (e.g., biased and/or moved toward the handle portion 112-3 and/or the fluid inlet conduit 122), such squeezing causing the trigger 104 to allow the first valve 120 to travel into an open position (or some degree of openness, depending upon an amount of travel imparted to the trigger 104 by the squeezing action).

In some embodiments, the hand-held solid chemical applicator assembly 100 may comprise a second valve 130 (e.g., a mixing valve) disposed within a valve housing 132*a-b*. The valve housing 132*a-b* may comprise, for example, a left housing member 132*a* and a right housing member 132*b*, as shown, with the mixing knob 106 coupled to engage the valve 130 in various positions—e.g., open, closed, and/or variable degrees of open/closed). According to some embodiments, the second valve 130 may be selectively varied to provide fluid flow (e.g., received from the first valve 120 and/or the fluid inlet conduit 122) to one or more of (i) a fluid conduit 134 in communication with a fluid outlet conduit 136 and (ii) a chemical chamber conduit 138. The second valve 130 may, for example, distribute received fluid flow in varying ratios between each of the fluid conduit 134 and the chemical chamber conduit 138 (e.g., in accordance with a positioning of the mixing knob 106). In some embodiments, in the case that the second valve 130 and/or the mixing knob 106 are set at a first extent of the second valve 130, all fluid flow received may be directed into the fluid conduit 134 and accordingly further onward to the fluid outlet conduit 136 and into the barrel 110. The fluid directed through the fluid conduit 134 may, for example, be directed out of the hand-held solid chemical applicator assembly 100 via the fluid outlet 110-1.

According to some embodiments, the fluid directed into the chemical chamber conduit 138 may enter a chemical chamber 140 (depicted with dotted lines for ease of illustration and/or to imply a transparency thereof). The chemical chamber 140 may define an interior volume, cavity, or void 140-1, for example, which accepts fluid from the chemical chamber conduit 138 via a chemical chamber inlet 140-2. In some embodiments, the chemical chamber inlet 140-2 may be disposed proximate to a first end 140-3 of the chemical chamber 140. The first end 140-3 may, for example, comprise an open end that is optionally and/or selectively sealed by engagement of the cap 118 and/or the latch 116. According to some embodiments, the chemical chamber 140 (and/or the housing 102*a-b*) may comprise a mounting feature 142 (also depicted with dotted lines for ease of illustration and/or to imply a transparency thereof) operable to receive and/or couple to the latch 116 and/or the cap 118. In some embodiments, a second, opposing end of the chemical chamber 140 may comprise a chemical chamber outlet 144 in communication with the fluid outlet conduit 136. As depicted, the fluid outlet conduit 136 may comprise a "Y"-type conduit and/or fitting that joins flows received from each of the fluid conduit 134 and the chemical chamber outlet 144. According to some embodiments, a grate, filter, or screen 146 may be disposed in the chemical chamber 140, e.g., proximate to the chemical chamber outlet 144, such as to prevent particulates over a certain size from exiting the chemical chamber 140.

In some embodiments, a chemical tablet 150 may be disposed in the chemical chamber 140 (e.g., as shown in FIG. 1B). The chemical tablet 150 may, for example, be inserted into the first open end 140-3 of the chemical chamber 140, such as in the case that the latch 116 and the cap 118 are rotationally oriented in "open" positions, permitting insertion of the chemical tablet 150 (e.g., as shown in FIG. 1A). According to some embodiments, the chemical tablet 150 may be sealed within the chemical chamber 140 by closing the cap 118 and/or engaging the latch 116. In such a manner, for example, the chemical tablet 150 may be dissolved by pressurized fluid flow entering the chemical chamber 150 via the chemical chamber inlet 140-2. In some embodiments, the chemical chamber inlet 140-2, the chemical chamber 140, and/or the hand-held solid chemical applicator assembly 100 may comprise a flow diverter 164 coupled and/or disposed to deflect or redirect fluid flow received via the chemical chamber inlet 140-2. In some embodiments, as described herein, the flow diverter 164 may facilitate desired dissolution attributes of the chemical tablet 150, such as by distributing incoming fluid flow across and/or around the chemical tablet 150 and/or by establishing a turbulent flow pattern within the chemical chamber 140. According to some embodiments, the chemical tablet 150 may be specially shaped or otherwise configured to provide desired dissolution attributes, such as by having an "hourglass" shape as depicted. In some embodiments, the chemical tablet 150 may be configured and/or formulated in a manner as described in co-pending and co-owned U.S. patent application Ser. No. 14/830,774 filed on Aug. 20, 2015 and titled "SYSTEM AND METHODS FOR TABLETIZED TUBE CLEANING", the chemical tablet configuration and formulation descriptions and concepts of which are hereby incorporated by reference herein. In some embodiments, the chemical tablet 150 may be specially-shaped such as depicted in co-pending and co-owned U.S. patent application Ser. No. 29/518,032 filed on Feb. 19, 2015 and titled "CHEMICAL TABLET" and/or co-pending and co-owned U.S. patent application Ser. No. 29/518,101 filed on Feb. 19, 2015 and titled "ELONGATED CHEMICAL TABLETS", the chemical tablet configurations of which are hereby incorporated by reference herein.

According to some embodiments, any or all of the components 102*a-b*, 102*b*-1, 102-2, 104, 106, 108, 110, 110-1, 110-2, 112-1, 112-2, 112-3, 112-4, 114, 114-1, 114-2, 116, 118, 120, 122, 122-1, 122-2, 130, 132*a-b*, 134, 136, 138, 140, 140-1, 140-2, 140-3, 142, 144, 146, 150 of the hand-held solid chemical applicator assembly 100 may be similar in configuration and/or functionality to any similarly named and/or numbered components described herein. Fewer or more components 102*a-b*, 102*b*-1, 102-2, 104, 106, 108, 110, 110-1, 110-2, 112-1, 112-2, 112-3, 112-4, 114, 114-1, 114-2, 116, 118, 120, 122, 122-1, 122-2, 130, 132*a-b*, 134, 136, 138, 140, 140-1, 140-2, 140-3, 142, 144, 146, 150 (and/or portions thereof) and/or various configurations of the components 102*a-b*, 102*b*-1, 102-2, 104, 106, 108, 110, 110-1, 110-2, 112-1, 112-2, 112-3, 112-4, 114, 114-1, 114-2, 116, 118, 120, 122, 122-1, 122-2, 130, 132*a-b*, 134, 136, 138, 140, 140-1, 140-2, 140-3, 142, 144, 146, 150 may be included in the hand-held solid chemical applicator assembly 100 without deviating from the scope of embodiments described herein. In some embodiments, one or more of the various components 102*a-b*, 102*b*-1, 102-2, 104, 106, 108, 110, 110-1, 110-2, 112-1, 112-2, 112-3, 112-4, 114, 114-1, 114-2, 116, 118, 120, 122, 122-1, 122-2, 130, 132*a-b*, 134, 136, 138, 140, 140-1, 140-2, 140-3, 142, 144, 146, 150 may not be needed and/or desired in the hand-held solid chemical applicator assembly 100.

Figure 2:
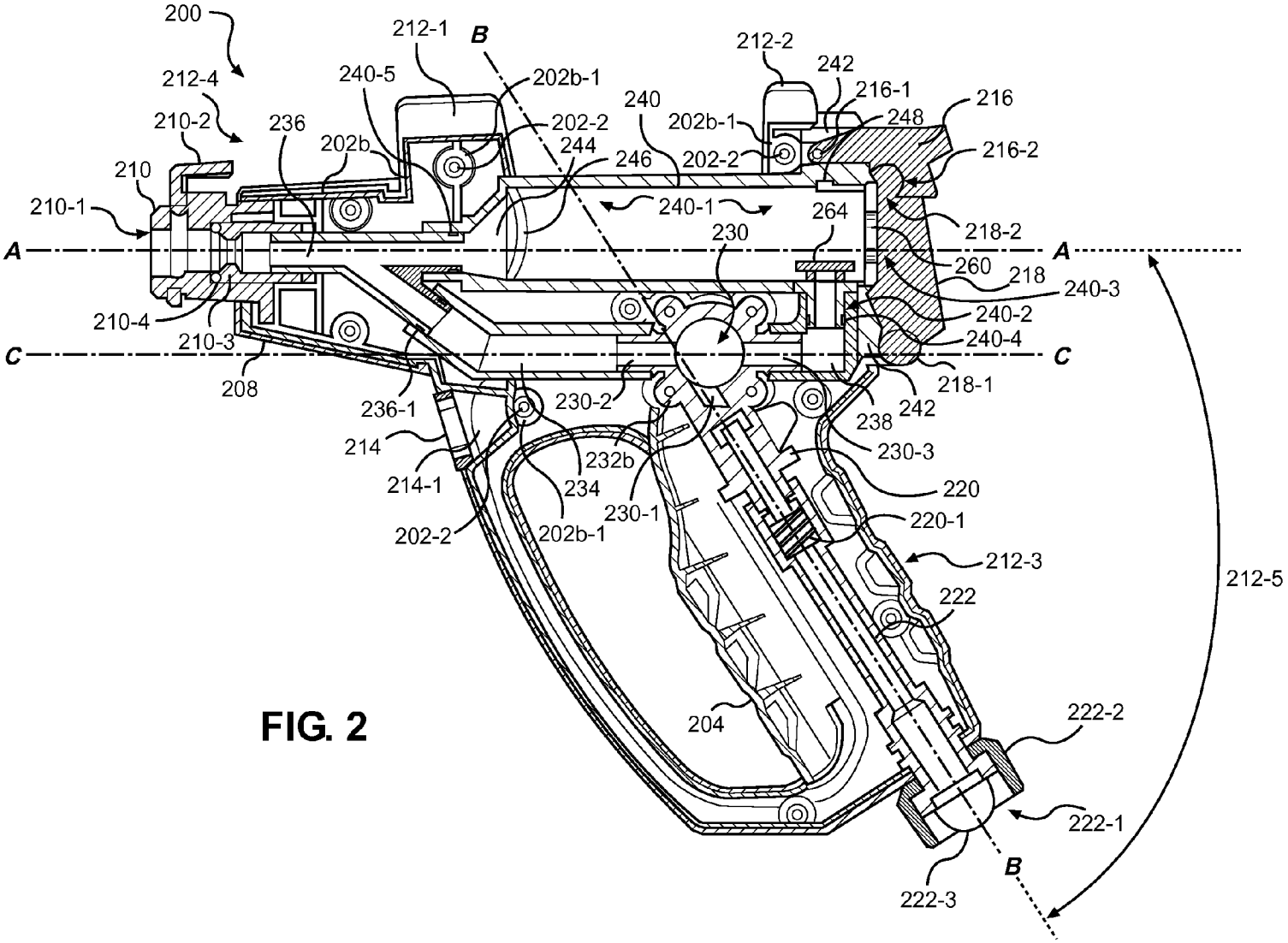
FIG. 2 is left-side cross section view of a hand-held solid chemical applicator assembly according to some embodiments.

Referring now to FIG. 2, a left-side cross section view of a hand-held solid chemical applicator assembly 200 according to some embodiments is shown. In some embodiments, the hand-held solid chemical applicator assembly 200 may be similar in configuration and/or functionality to the hand-held solid chemical applicator assembly 100 of FIG. 1A and FIG. 1B herein. According to some embodiments, the hand-held solid chemical applicator assembly 200 may comprise a cross-sectional view of the hand-held solid chemical applicator assembly 100 of FIG. 1A and FIG. 1B. The hand-held solid chemical applicator assembly 200 may comprise, in some embodiments, a right-side housing 202*b* comprising a plurality of attachment points 202*b*-1 such as may accept fasteners 202-2. In some embodiments, the fasteners 202-2 may join the right-side housing 202*b* to a left-side housing (not shown in FIG. 2; e.g., the left housing 102*a* of FIG. 1A).

According to some embodiments, the hand-held solid chemical applicator assembly 200 may comprise a valve actuator 204 (e.g., shaped as a trigger or grip in FIG. 2), a fore grip 208, and/or a nozzle 210. In some embodiments, the nozzle 210 may define an internal passage such as a fluid outlet 210-1 and/or may include and/or accept a wand retainer 210-2. In some embodiments, the nozzle 210 may house, couple to, and/or retain an extension clip 210-3 that may, for example, engage with various extensions (e.g., extension wands and/or extension nozzles; neither of which are shown in FIG. 2) inserted into the nozzle 210 and/or through the fluid outlet 210-1. According to some embodiments, a seal 210-4 (e.g., an O-ring) may be coupled and/or disposed between the nozzle 210 (e.g., an inside surface thereof) and the extension clip 210-3 (e.g., an exterior surface thereof), such that fluid flowing through the extension clip 210-3 and transferred into the nozzle 210 and/or the fluid outlet 210-1 may be prevented from leaking radially there from. In some embodiments, the nozzle 210 and/or the extension clip 210-3 may be oriented along a first axis "A". As depicted in FIG. 2, for example, each of the nozzle 210 and the extension clip 210-3 may comprise and/or define the fluid outlet 210-1, defined as a cylindrical interior passage, with the axis of the cylindrical shape being aligned with the first axis "A". According to some embodiments, the first axis "A" may comprise a horizontal axis and/or may be generally horizontally-oriented during operation of the hand-held solid chemical applicator assembly 200.

In some embodiments, the hand-held solid chemical applicator assembly 200 and/or the right-side housing 202*b* thereof may comprise a forward extension retaining feature 212-1 and/or a rear extension retaining feature 212-2. An extension wand (not shown) may, for example, be engaged with the forward extension retaining feature 212-1 and/or the rear extension retaining feature 212-2 (and/or mating portions thereof on a left-side housing (not shown in FIG. 2)) to removably mount and/or couple the extension wand to the hand-held solid chemical applicator assembly 200 (e.g., for convenient storage and/or transport). In some embodiments, the engaged extension wand may be selectively retained by the wand retainer 210-2. According to some embodiments, the right-side housing 202*b* and/or the hand-held solid chemical applicator assembly 200 may comprise and/or define a handle portion 212-3 oriented along a second axis "B" and/or a body portion 212-4 oriented along the first axis "A".

According to some embodiments, the first axis "A" and the second axis "B" may be oriented to intersect and form and/or define, with respect to each other, an angle 212-5. In some embodiments, such as depicted in FIG. 2, the angle 212-5 may comprise an acute angle, such that the handle portion 212-3 is pitched forward toward the fluid outlet 210-1. According to some embodiments, the second axis "B" may be oriented to intersect the first axis "A" normally, i.e., to form the angle 212-5 as a right angle. In some embodiments, the angle 212-5 may be formed at less than normal (i.e., less than ninety degrees) (90°). In some embodiments, the handle portion 212-3 and the second axis "B" may be oriented to form the angle 212-5 in the range of thirty-five degrees (35°) to fifty-five degrees (55°)—e.g., as shown in FIG. 2. According to some embodiments, the second axis "B" may comprise a vertical axis and/or may be generally vertically-oriented during operation of the hand-held solid chemical applicator assembly 200.

In some embodiments, the hand-held solid chemical applicator assembly 200 may comprise an accessory mount 214 seated in and/or covering an accessory storage space 214-1, e.g., to accept and/or store one or more accessories such as one or more extension or accessory nozzles (not shown in FIG. 2; e.g., the nozzle 114-2 of FIG. 1A). According to some embodiments, the hand-held solid chemical applicator assembly 200 may comprise a latch 216. In some embodiments, the latch 216 may comprise a hinged latch 216. The latch 216 may comprise, for example, a latch pivot 216-1 coupled to the right-side housing 202*b* (and/or another element of the hand-held solid chemical applicator assembly 200) such that the latch 216 may pivot toward and away from the first axis "A". In some embodiments, the latch 216 may comprise a latching feature 216-2 that is operable to (e.g., shaped to) engage and/or mate with a cap 218. The cap 218 may, for example, comprise a hinged cap 218 comprising a cap pivot 218-1 coupled to the right-side housing 202*b* (and/or another element of the hand-held solid chemical applicator assembly 200) such that the cap 218 may pivot toward and away from the first axis "A". In some embodiments, the cap 218 may comprise a retaining feature 218-2 that is operable to (e.g., shaped to) be engaged by and/or mated with the latching feature 216-2 of the latch 216 to secure the cap 218 in a closed position (e.g., secured against the body portion 212-4 and/or in a position substantially normal to the first axis "A"; e.g., the position shown in FIG. 2).

According to some embodiments, the hand-held solid chemical applicator assembly 200 may comprise a flow regulation valve 220 (e.g., a first valve). The flow regulation valve 220 may, for example, be cooperative with a spring 220-1 (and/or other biasing element) and the valve actuator 204 to be selectively opened and closed. In some embodiments, the flow regulation valve 220 may receive a fluid flow from a fluid inlet conduit 222. The fluid inlet conduit 222 may, for example, comprise a closed conduit having a first end distal from the flow regulation valve 220 and defining a fluid inlet 222-1, the fluid inlet 222-1 being operable to accept a fluid flow from an external source (not shown) such as a hose, tube, or pipe of a pressurized water source. According to some embodiments, the fluid inlet conduit 222 (and/or the hand-held solid chemical applicator assembly 200) may be coupled to an external fluid source via a hose coupler 222-2 and/or may comprise a filter or screen element 222-3 through which incoming fluid flow must pass to enter the fluid inlet conduit 222 (e.g., to filter out particulates that may be present in the incoming fluid flow). According to some embodiments, the flow regulation valve 220, the spring 220-1, and/or the fluid inlet conduit 222 may be oriented and/or disposed along the second axis "B", e.g., within the handle portion 212-3.

In some embodiments, the hand-held solid chemical applicator assembly 200 may comprise a mixing valve 230. The mixing valve 230 may, for example, comprise and/or define a mixing inlet 230-1 and a plurality of mixing outlets 230-2, 230-3 (e.g., two (2), as shown in FIG. 2) formed by and/or housed in a mixing valve housing 232*b*. According to some embodiments, the mixing valve 230 and/or the mixing valve inlet 230-1 thereof may be coupled and/or disposed to accept fluid flow from the flow regulation valve 220. In such a manner, for example, and depending upon a setting (degree of open or closed) of the mixing valve 230, fluid flow provided to the hand-held solid chemical applicator assembly 200 (e.g., vie the fluid inlet 222-1) and selectively regulated by engagement of the valve actuator 204 with the flow regulation valve 220, may be provided to one or more of the mixing outlets 230-2, 230-3. In some embodiments, a first mixing outlet 230-2 may be coupled to provide fluid flow to a rinse conduit 234. The rinse conduit 234 may, in some embodiments, be coupled to provide the fluid flow to an effluent conduit 236 that is in communication with and/or coupled to provide the fluid flow to the nozzle 210 and/or the fluid outlet 210-1. According to some embodiments, a seal 236-1 (e.g., an O-ring) may be coupled and/or disposed between the rinse conduit 234 (e.g., an inside surface thereof) and the effluent conduit 236 (e.g., an exterior surface thereof), such that fluid flowing through the rinse conduit 234 and transferred into the effluent conduit 236 may be prevented from leaking radially there from.

In some embodiments, the mixing outlets 230-2, 230-3 of the mixing valve 230 and/or at least a portion of the rinse conduit 234 may be oriented and/or disposed along a third axis "C". The third axis "C" may, for example, be parallel to the first axis "A" (e.g., and may accordingly also form and/or define the angle 212-5 between the third axis "C" and the second axis "B").

According to some embodiments, a second mixing outlet 230-3 may be coupled to provide fluid flow to a chamber conduit 238. In some embodiments, the chamber conduit 238 may comprise an elbow or angled closed conduit that, e.g., redirects fluid flow along the third axis "C" to a direction angled with respect to the third axis "C" (e.g., normal or ninety degrees (90°) in the case of a ninety degree (90°) elbow). The chamber conduit 238 may, in some embodiments, be coupled to provide the redirected fluid flow to a chemical tablet chamber 240. The chemical tablet chamber 240 may, for example, form or define a void or interior volume 240-1 oriented and/or disposed along the first axis "A" and/or coupled to receive the fluid flow from the chamber conduit 238 via a chamber inlet 240-2. In some embodiments, the chemical tablet chamber 240 may comprise a transparent cylindrical chamber open at a first end 240-3 and operable to receive a chemical tablet (not shown in FIG. 2; e.g., the chemical tablet 150 of FIG. 1A and FIG. 1B) there through. In some embodiments, the chamber inlet 240-2 may be disposed to accept the incoming fluid flow proximate to the first end 240-3 and/or in a direction normal (or otherwise angled with respect) to both the first axis "A" and the orientation of the chemical tablet chamber 240. The chamber inlet 240-2 may receive fluid flow along a radius of a cylindrically shaped chemical tablet chamber 240, for example. According to some embodiments, a seal 240-4 (e.g., an O-ring) may be coupled and/or disposed between the chamber conduit 238 (e.g., an inside surface thereof) and the chamber inlet 240-2 (e.g., an exterior surface thereof), such that fluid flowing through the chamber conduit 238 and transferred into the chamber inlet 240-2 may be prevented from leaking radially there from.

In some embodiments, the chemical tablet chamber 240 (and/or the right-side housing 202*b* or the hand-held solid chemical applicator assembly 200) may comprise one or more mounting features 242 to which one or more of the latch 216 and the cap 218 are coupled. Each of the latch pivot 216-1 and the cap pivot 218-1 may be rotatably coupled to the one or more mounting features 242 forming hinge joints, for example, such that each of the latch 216 and the cap 218 may be variably and/or selectively rotationally positioned with respect to the open first end 240-3 of the chemical tablet chamber 240. As depicted in FIG. 2, the latch 216 and the cap 218 may be coupled to the hand-held solid chemical applicator assembly 200 (and/or the chemical tablet chamber 240 and/or the one or more mounting features 242 thereof) at or on opposing sides of the chemical tablet chamber 240. The latch 216 may be coupled (e.g., via the latch pivot 216-1) to the hand-held solid chemical applicator assembly 200 above the open first end 240-3 of the chemical tablet chamber 240 (e.g., on a first side thereof), for example, while the cap 218 may be coupled (e.g., via the cap pivot 218-1) to the hand-held solid chemical applicator assembly 200 below the open first end 240-3 of the chemical tablet chamber 240 (e.g., on a second, opposing side thereof).

According to some embodiments, the chemical tablet chamber 240 may comprise a second end disposed opposite from the open first end 240-3, the second end defining and/or comprising a chamber outlet 244. In some embodiments, the chamber outlet 244 may be coupled to and/or in communication with the effluent conduit 236 (and/or a portion thereof). In such a manner, for example, fluid flow entering the chemical tablet chamber 240 via the chamber inlet 240-2 may be transmitted through the interior volume 240-1 (e.g., to dissolve a chemical tablet (not shown) therein), to the chamber outlet 244, into the effluent conduit 236 and to the fluid outlet 210-1 of the nozzle 210. In some embodiments, a seal 240-5 (e.g., an O-ring) may be coupled and/or disposed between the chamber outlet 244 (e.g., an inside surface thereof) and the effluent conduit 236 (e.g., an exterior surface thereof), such that fluid flowing through the chamber outlet 244 and transferred into the effluent conduit 236 may be prevented from leaking radially there from.

In some embodiments, the hand-held solid chemical applicator assembly 200 and/or the chemical tablet chamber 240 may comprise and/or house a screen element 246 proximate to the chamber outlet 244, e.g., to prevent larger portions or chunks of partially-dissolved chemical tablet (not shown) from exiting the chemical tablet chamber 240 with the fluid flow. According to some embodiments, the chemical tablet chamber 240 may comprise a detent 248 operable to receive and/or mount or couple to an orifice assembly 260. The orifice assembly 260 may, for example, restrict the opening of the open first end 240-3 (not readily visible in FIG. 2) such that the shapes, sizes, and/or types of chemical tablets that may be inserted into the chemical tablet chamber 240 may be governed. In some embodiments, the orifice assembly 260, the chemical chamber 240, and/or the chamber inlet 240-2 may comprise and/or define a flow diverter 264. The flow diverter 264 may, for example, divert the flow received from the chamber inlet 240-2 from an incoming angle with respect to the first axis "A". According to some embodiments, the flow diverter 264 may divert the incoming flow along the first axis "A" toward the chamber outlet 244. In some embodiments, the flow diverter 264 may divert the incoming flow from incoming along a radius of a cylindrically shaped chemical tablet chamber 240 to a circumference (or wall in the case of a non-cylindrically shaped chemical tablet chamber 240) of the chemical tablet chamber 240—e.g., a circumferential flow. In some embodiments, the diverted flow may provide desirable dissolution of the chemical tablet (not shown) in the chemical tablet chamber 240.

According to some embodiments, any or all of the components 202*b*, 202*b*-1, 202-2, 204, 208, 210, 210-1, 210-2, 210-3, 210-4, 212-1, 212-2, 212-3, 212-4, 212-5, 214, 214-1, 216, 216-1, 216-2, 218, 218-1, 218-2, 220, 220-1, 222, 222-1, 222-2, 230, 230-1, 230-2, 230-3, 232*b*, 234, 236, 236-1, 238, 240, 240-1, 240-2, 240-3, 240-4, 240-5, 242, 244, 246, 248, 260, 264 of the hand-held solid chemical applicator assembly 200 may be similar in configuration and/or functionality to any similarly named and/or numbered components described herein. Fewer or more components 202*b*, 202*b*-1, 202-2, 204, 208, 210, 210-1, 210-2, 210-3, 210-4, 212-1, 212-2, 212-3, 212-4, 212-5, 214, 214-1, 216, 216-1, 216-2, 218, 218-1, 218-2, 220, 220-1, 222, 222-1, 222-2, 230, 230-1, 230-2, 230-3, 232*b*, 234, 236, 236-1, 238, 240, 240-1, 240-2, 240-3, 240-4, 240-5, 242, 244, 246, 248, 260, 264 (and/or portions thereof) and/or various configurations of the components 202*b*, 202*b*-1, 202-2, 204, 208, 210, 210-1, 210-2, 210-3, 210-4, 212-1, 212-2, 212-3, 212-4, 212-5, 214, 214-1, 216, 216-1, 216-2, 218, 218-1, 218-2, 220, 220-1, 222, 222-1, 222-2, 230, 230-1, 230-2, 230-3, 232*b*, 234, 236, 236-1, 238, 240, 240-1, 240-2, 240-3, 240-4, 240-5, 242, 244, 246, 248, 260, 264 may be included in the hand-held solid chemical applicator assembly 200 without deviating from the scope of embodiments described herein. In some embodiments, one or more of the various components 202*b*, 202*b*-1, 202-2, 204, 208, 210, 210-1, 210-2, 210-3, 210-4, 212-1, 212-2, 212-3, 212-4, 212-5, 214, 214-1, 216, 216-1, 216-2, 218, 218-1, 218-2, 220, 220-1, 222, 222-1, 222-2, 230, 230-1, 230-2, 230-3, 232*b*, 234, 236, 236-1, 238, 240, 240-1, 240-2, 240-3, 240-4, 240-5, 242, 244, 246, 248, 260, 264 may not be needed and/or desired in the hand-held solid chemical applicator assembly 200.

Figure 3:
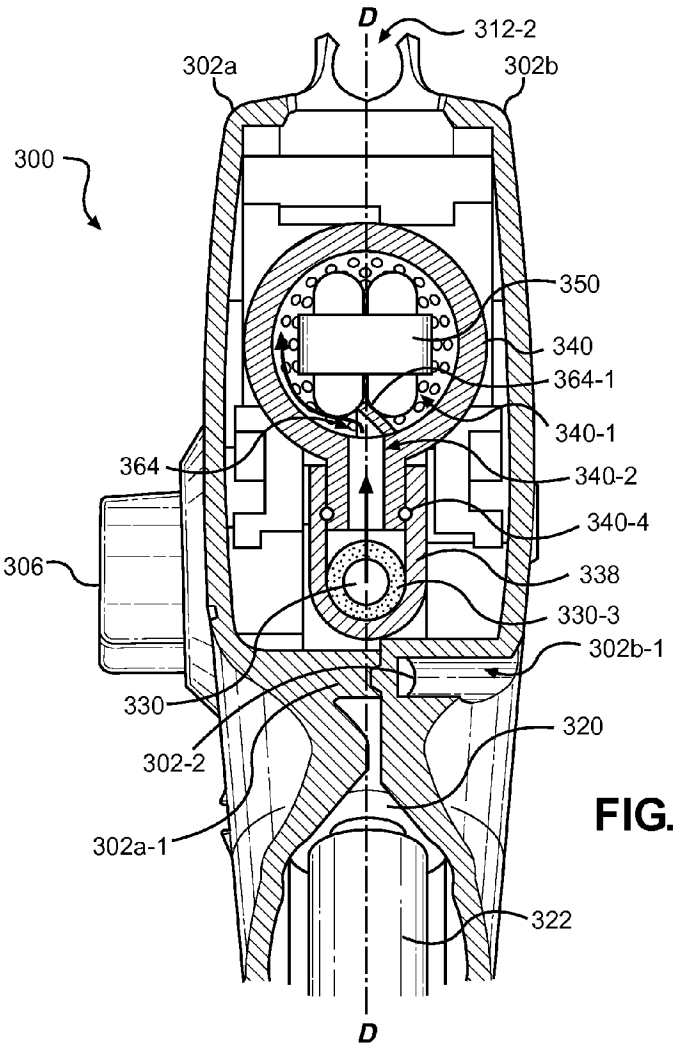
FIG. 3 is rear cross section view of a hand-held solid chemical applicator assembly according to some embodiments.

Turning now to FIG. 3, a rear cross section view of a hand-held solid chemical applicator assembly 300 according to some embodiments is shown. In some embodiments, the hand-held solid chemical applicator assembly 300 may be similar in configuration and/or functionality to either or both of the hand-held solid chemical applicator assemblies 100, 200 of FIG. 1A, FIG. 1B, and/or FIG. 2 herein (or portions thereof). In some embodiments, the hand-held solid chemical applicator assembly 300 may comprise a housing 302*a*-*b* comprising a left housing element 302*a* and a right housing element 302*b* joined together by a coupling of one or more left mating features 302*a*-1 with one or more right mating features 302*b*-1. The mating features 302*a*-1, 302*b*-1 may, for example, be removably engaged with a fastener 302-2 (e.g., a screw or bolt). In some embodiments, the housing 302*a*-*b* may define and/or comprise a clip element 312-2 operable to removably engage with and/or retain a cylindrically shaped object such as an extension wand (not shown). In some embodiments, the hand-held solid chemical applicator assembly 300 may comprise a mixing valve control knob 306.

According to some embodiments, the hand-held solid chemical applicator assembly 300 may comprise a flow valve 320 coupled to receive pressurized fluid flow from a fluid intake 322. The flow valve 320 may, for example, be utilized to selectively vary and/or control the flow rate of incoming fluid. In some embodiments, the regulated/variable flow may be directed, by the flow valve 320 to a mixing valve 330. The mixing valve 330 may, for example, be selectively engaged by a turning force applied to the mixing valve control knob 306, to vary a proportion of incoming flow directed along various tubes and/or conduits such as a mixing outlet conduit 330-3 as shown in FIG. 3. According to some embodiments, flow through the mixing outlet conduit 330-3 may be directed into an elbow 338 that redirects the fluid flow from traveling in a first mixing effluent direction (out of the page of FIG. 3) to a second direction along an axis "D". The elbow 338 may, for example, direct the fluid flow along the axis "D" into a cylindrical body 340.

In some embodiments, the cylindrical body 340 may define an interior volume 340-1 (circularly shaped in the cross-section of FIG. 3) and/or may comprise a fluid inlet 340-2. According to some embodiments, the coupling of the fluid inlet 340-2 of the cylindrical body 340 and the elbow 338 may comprise an O-ring 340-3 to facilitate a water-tight seal. In some embodiments, a chemical tablet 350 may be disposed in the cylindrical body 340. The chemical tablet 350 may comprise, for example, an "hourglass" shaped tablet as shown, or may comprise other tablet configurations, e.g., as referenced herein.

According to some embodiments, a flow diverter 364 may be disposed at and/or in the fluid inlet 340-2. The flow diverter 364 may, for example, comprise an angled diversion surface 364-1 disposed in the path of the incoming fluid flow along the axis "D" such that fluid entering the cylindrical body 340 is directed to flow along an inside circumference of the cylindrical body 340, as depicted by the flow arrows in FIG. 3. In such a manner, for example, the incoming flow may be more evenly distributed around and/or across the chemical tablet 350 (and/or features thereof) to provide desired dissolution attributes and/or characteristics. It may be desirable, for example, to achieve a certain target dissolution rate for the chemical tablet 350 such that the chemical tablet 350 does not dissolve too quickly (e.g., and provide an excessive concentration of chemical in a cleaning effluent, as well as require premature replacement of the chemical tablet 350) or too slowly (e.g., provide an ineffectual concentration of chemical in a cleaning effluent). In some embodiments, the combination of the "hourglass" shaped chemical tablet 350 with the circumferential flow caused by the flow diverter 364 may provide a desirable distribution of incoming flow in contact with the shaped chemical tablet 350 to achieve desired dissolution characteristics (e.g., which may be dependent upon a specific formulation of the chemical tablet 350).

In some embodiments, any or all of the components 302*a*-*b*, 302*a*-1, 302*b*-1, 302-2, 306, 312-2, 320, 322, 330, 330-3, 340, 340-1, 340-2, 340-4, 350, 364, 364-1 of the hand-held solid chemical applicator assembly 300 may be similar in configuration and/or functionality to any similarly named and/or numbered components described herein. Fewer or more components 302*a*-*b*, 302*a*-1, 302*b*-1, 302-2, 306, 312-2, 320, 322, 330, 330-3, 340, 340-1, 340-2, 340-4, 350, 364, 364-1 (and/or portions thereof) and/or various configurations of the components 302*a*-*b*, 302*a*-1, 302*b*-1, 302-2, 306, 312-2, 320, 322, 330, 330-3, 340, 340-1, 340-2, 340-4, 350, 364, 364-1 may be included in the hand-held solid chemical applicator assembly 300 without deviating from the scope of embodiments described herein. In some embodiments, one or more of the various components 302*a*-*b*, 302*a*-1, 302*b*-1, 302-2, 306, 312-2, 320, 322, 330, 330-3, 340, 340-1, 340-2, 340-4, 350, 364, 364-1 may not be needed and/or desired in the hand-held solid chemical applicator assembly 300.

Referring now to FIG. 4A, FIG. 4B, FIG. 4C, FIG. 4D, FIG. 4E, FIG. 4F, and FIG. 4G, an upper, right-rear perspective view, a rear view, a front view, a top view, a bottom view, a right-side view, and a left-side view, respectively, of a hand-held solid chemical applicator multi-purpose element 460 according to some embodiments are shown. In some embodiments, the multi-purpose element 460 may comprise a circular shaped base 462 defining an orifice 462-1 there through. The orifice 462-1 may, for example, be coupled to a hand-held solid chemical applicator and/or portion thereof (not shown in FIG. 4A, FIG. 4B, FIG. 4C, FIG. 4D, FIG. 4E, FIG. 4F, and FIG. 4G; e.g., the hand-held solid chemical applicator 100, 200, 300 of FIG. 1A, FIG. 1B, FIG. 2, and/or FIG. 3 herein). In some embodiments, the orifice 462-1 may partially restrict and/or govern entry of a chemical tablet (not shown; e.g., the chemical tablet 150, 350 of FIG. 1A, FIG. 1B, and/or FIG. 3 herein) insertion into a chemical chamber and/or cylindrical body (or an interior volume thereof; not shown; e.g., the chemical chamber 140 of FIG. 1A and FIG. 1B, the chemical tablet chamber 240 of FIG. 2, and/or the cylindrical body 340 of FIG. 3). As depicted, for example, the orifice 462-1 may define an "hourglass" shape operable to accept an "hourglass" shaped chemical tablet. While the "hourglass" shape is depicted for exemplary purposes with respect to the orifice 462-1, other shapes and/or configurations of the orifice 462-1 may be utilized without deviating from some embodiments. According to some embodiments, for example, the orifice 462-1 may generally define an opening having a different shape and/or smaller dimensions than a chemical chamber to which the multi-purpose element 460 is operably coupled.

In some embodiments, the multi-purpose element 460 may comprise and/or be coupled to a flow diverter 464. The flow diverter 464 may, for example, be formed on and/or coupled to the multi-purpose element 460 such that upon coupling of the multi-purpose element 460 to a chemical chamber/cylindrical body (e.g., at an open end thereof) the flow diverter 464 may be operably positioned and/or disposed to deflect fluid flow introduced into the chemical chamber/cylindrical body. According to some embodiments, the flow diverter 464 may comprise an angled deflection surface 464-1 and/or one or more piers or supports 464-2. The angled deflection surface 464-1 may, for example, intercept fluid flow introduced from beneath the flow diverter 464 that, e.g., is provided in a radially inward direction with respect to the circular shaped base 462, and deflect and/or redirect such flow (e.g., as depicted by the flow arrows in FIG. 4C) toward and/or along a circumference of the circular shaped base 462 and/or a chemical chamber/cylindrical body coupled thereto. In such a manner, for example, the fluid flow may be more desirably dispersed about and/or around the chemical tablet, e.g., preventing what otherwise may comprise severe spot-dissolution of the chemical tablet.

Figure 4A:
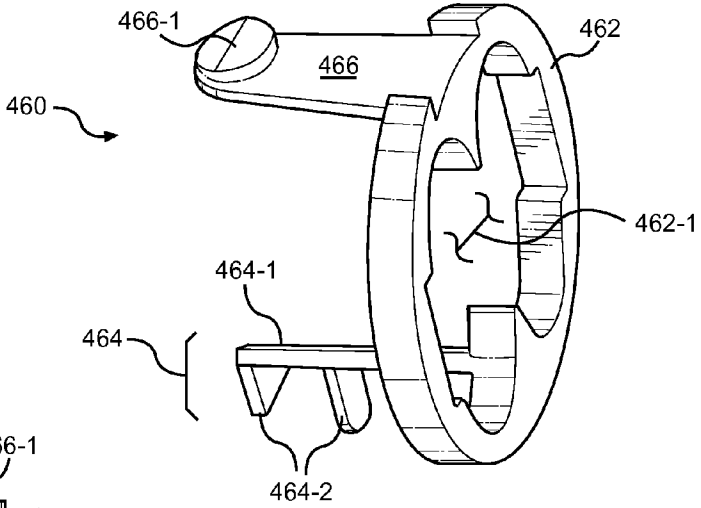
FIG. 4A, FIG. 4B, FIG. 4C, FIG. 4D, FIG. 4E, FIG. 4F, and FIG. 4G are an upper, right-rear perspective view, a rear view, a front view, a top view, a bottom view, a right-side view, and a left-side view, respectively, of a hand-held solid chemical applicator multi-purpose element according to some embodiments.
Figure 4C:
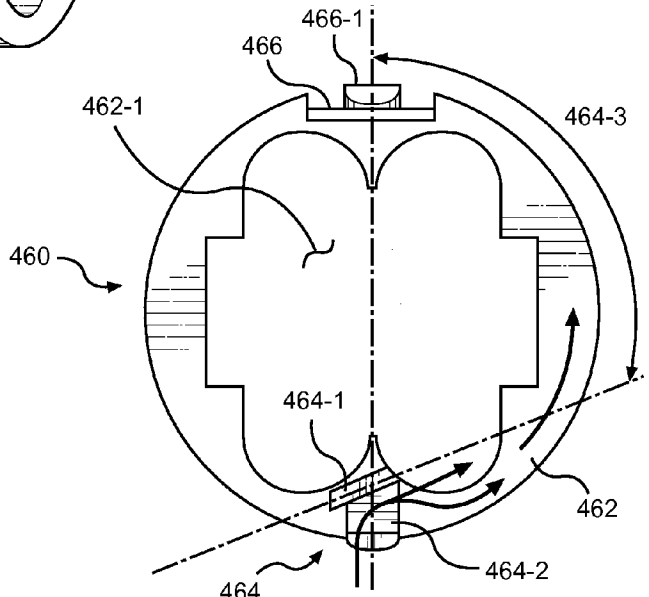
Figure 4B:
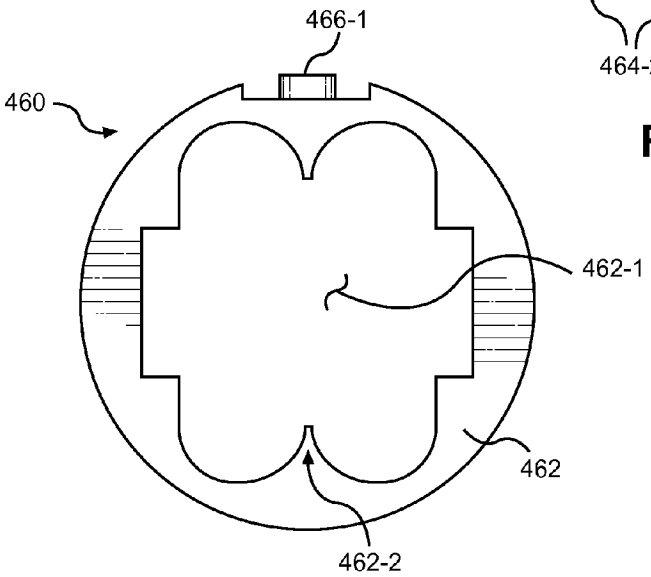
Figure 4E:
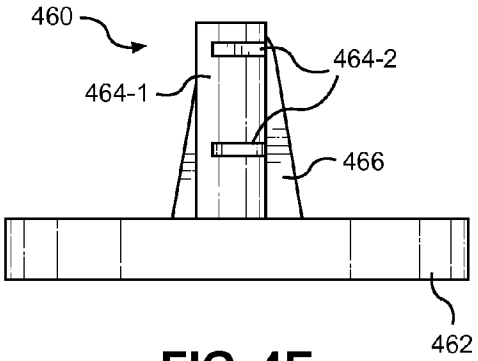
Figure 4G:
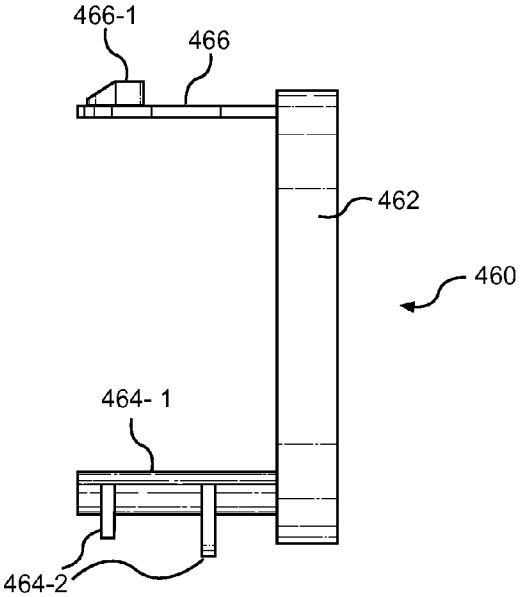
Figure 4D:
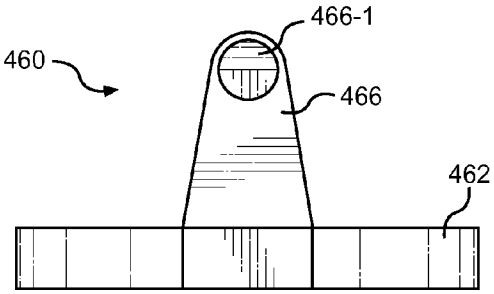
Figure 4F:
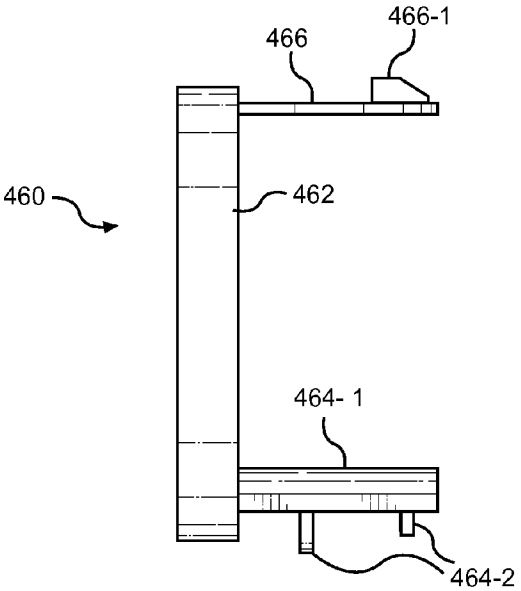
Figure 5A:
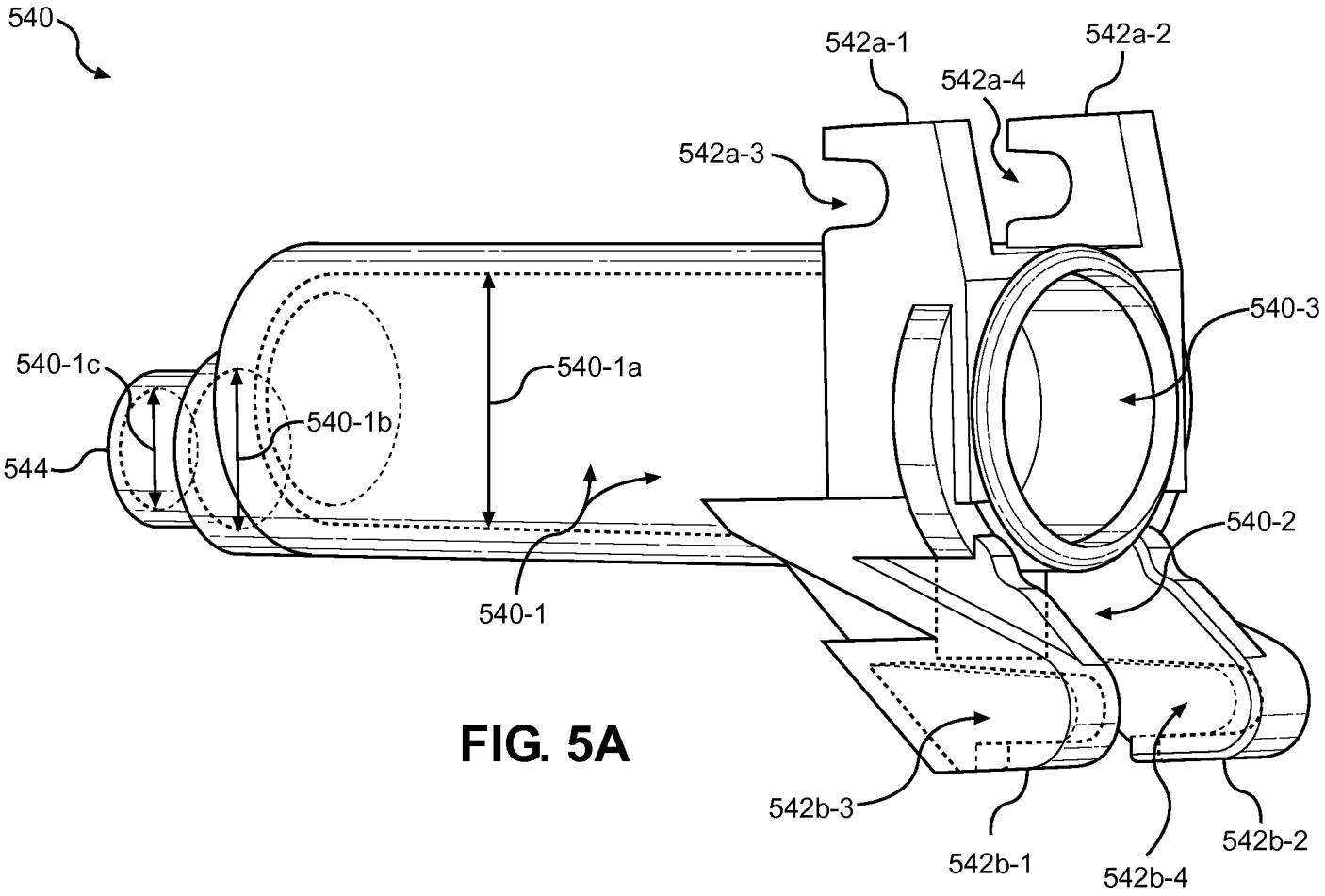
FIG. 5A, FIG. 5B, FIG. 5C, FIG. 5D, FIG. 5E, FIG. 5F, and FIG. 5G are an upper, right-rear perspective view, a rear view, a front view, a top view, a bottom view, a left-side view, and a right-side view, respectively, of a chemical tablet dissolution element according to some embodiments.
Figure 5C:
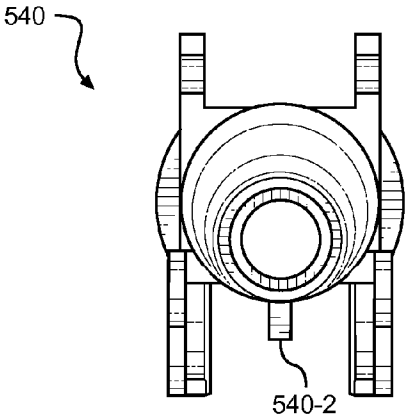
Figure 5E:
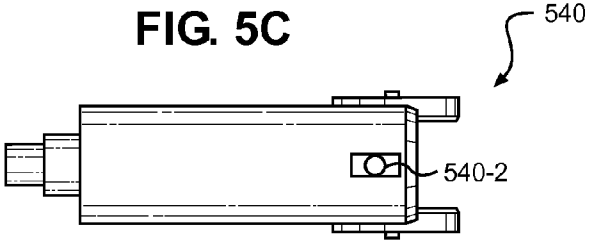
Figure 5G:
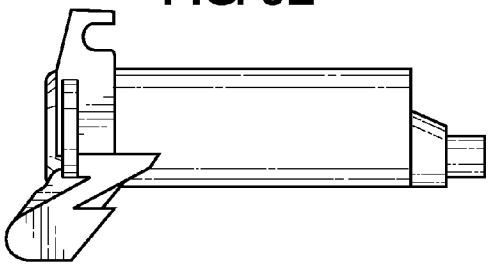
Figure 5B:
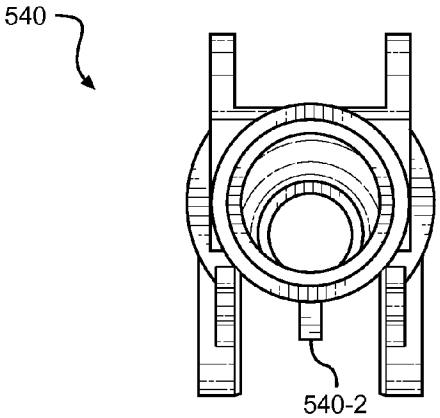
Figure 5D:
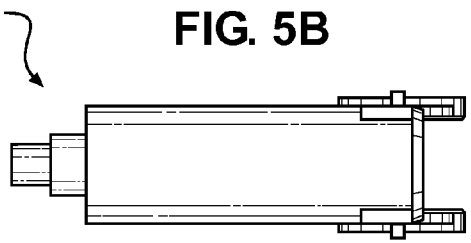
Figure 5F:
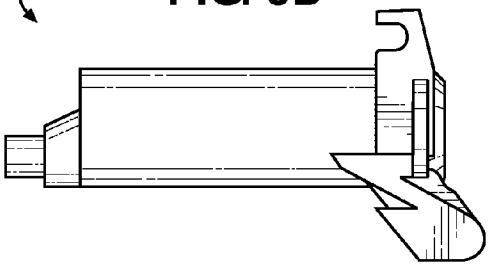

According to some embodiments, the flow diverter 464 may be advantageous depending upon the shape of the chemical tablet. In the case of the "hourglass" shaped (e.g., co-joined and/or combined oval or elliptical shapes joined at or near a tangent to their major axis) orifice 462-1 and an attendant "hourglass" shaped chemical tablet (not shown), for example, non-diverted radially inward flow may tend to cause severe spot-dissolution of the chemical tablet at the lower pinch point or juncture 462-2 of the "hourglass" shaped orifice 462-1 (as shown in FIG. 4B). In such a case, it may be desirable to deflect the incoming flow with the flow diverter 464. In some embodiments, such as in the case that a lower portion of a chemical tablet is shaped differently, e.g., to reduce spot-dissolution effects, the flow diverter 464 may not be required and/or may be provided with a different configuration than is shown. According to some embodiments, the angled deflection surface 464-1 may be disposed to deflect incoming radial flow at an angle 464-3 with respect to the original path of the incoming flow, as depicted in FIG. 4C. In some embodiments, the angle 464-3 may comprise an acute angle such as in the range of thirty-five degrees (35°) to fifty-five degrees (55°).

In some embodiments, the multi-purpose element 460 may comprise a tab 466 comprising a projection 466-1. The tab 466 may, in the case that the multi-purpose element 460 is coupled to an open end of a chemical chamber/cylindrical body for example, cause an alignment of the projection 466-1 with a detent and/or catch feature (not shown; e.g., the detent 248 of FIG. 2 herein) of the chemical chamber/cylindrical body. In such a manner, for example, the multi-purpose element 460 may be coupled to the chemical chamber/cylindrical body. In some embodiments, the tab 466 may be pliant and/or elastic such that a downward or radially inward force applied to the projection 466-1 may cause the tab 466 to deflect. In such a manner, for example, a release force may be applied to the projection 466-1 to disengage and/or decouple the multi-purpose element 460 from the chemical chamber/cylindrical body. While the circular shaped base 462 defining the orifice 462-1 is depicted as comprising or being coupled to the flow diverter 464, in some embodiments the flow diverter 464 and the circular shaped base 462 defining the orifice 462-1 may comprise separate elements of a hand-held solid chemical applicator assembly.

According to some embodiments, any or all of the components 462, 462-1, 462-2, 464, 464-1, 464-2, 464-3, 466, 466-1 of the hand-held solid chemical applicator multi-purpose element 460 may be similar in configuration and/or functionality to any similarly named and/or numbered components described herein. Fewer or more components 462, 462-1, 462-2, 464, 464-1, 464-2, 464-3, 466, 466-1 (and/or portions thereof) and/or various configurations of the components 462, 462-1, 462-2, 464, 464-1, 464-2, 464-3, 466, 466-1 may be included in the hand-held solid chemical applicator multi-purpose element 460 without deviating from the scope of embodiments described herein. In some embodiments, one or more of the various components 462, 462-1, 462-2, 464, 464-1, 464-2, 464-3, 466, 466-1 may not be needed and/or desired in the hand-held solid chemical applicator multi-purpose element 460.

Referring now FIG. 5A, FIG. 5B, FIG. 5C, FIG. 5D, FIG. 5E, FIG. 5F, and FIG. 5G are an upper, right-rear perspective view, a rear view, a front view, a top view, a bottom view, a left-side view, and a right-side view, respectively, of a chemical tablet dissolution element 540 according to some embodiments are shown. In some embodiments, the chemical tablet dissolution element 540 may comprise a cylindrically shaped body defining an interior volume 540-1. In some embodiments, different portions of the cylindrically shaped body may be sized differently. The interior volume 540-1 may, for example, be defined at least partially by a first portion having a first diameter 540-1*a*, a second portion having a second diameter 540-1*b*, and/or a third portion having a third diameter 540-1*c*. According to some embodiments, the third diameter 540-1*c* may be smaller than the second diameter 540-1*b* and the second diameter 540-1*b* may be smaller than the first diameter 540-1*a*. In such a manner, for example, the chemical tablet dissolution element 540 and/or the interior volume 540-1 thereof may taper from one end to another. In some embodiments, the chemical tablet dissolution element 540 may comprise a fluid inlet 540-2 formed near a first end 540-3 of the chemical tablet dissolution element 540, such as to receive a fluid flow. The fluid inlet 540-2 may, for example, accept incoming pressurized fluid flow from other components and/or elements (not shown) of a hand-held solid chemical applicator and/or portion thereof (not shown in FIG. 4A, FIG. 4B, FIG. 4C, FIG. 4D, FIG. 4E, FIG. 4F, and FIG. 4G; e.g., the hand-held solid chemical applicator 100, 200, 300 of FIG. 1A, FIG. 1B, FIG. 2, and/or FIG. 3 herein).

In some embodiments, the first end 540-3 may comprise and/or define an opening, e.g., through which a solid chemical tablet (not shown; e.g., the chemical tablet 150, 350 of FIG. 1A, FIG. 1B, and/or FIG. 3 herein) may be inserted into the interior volume 540-1 (e.g., the first portion thereof having the first diameter 540-1*a*). According to some embodiments, a depth of insertion of a chemical tablet into the interior volume 540-1 may be limited by the transition from the first diameter 540-1*a* to the second diameter 540-1*b* (e.g., the chemical tablet may comprise a diameter smaller than the first diameter 540-1*a* but larger than the second diameter 540-1*b*). In some embodiments, the fluid flow received via the fluid inlet 540-2 may be directed into the interior volume 540-1 to dissolve a solid chemical tablet located therein. In some embodiments, the dissolved chemical tablet, fluid flow, and/or a resulting mixture or solution (e.g., a chemical cleaning solution) may be transmitted through the interior volume 540-1 to a fluid outlet 544. In operation, for example, the first end 540-3 may be sealed or closed such that pressurized fluid flow is directed from the fluid inlet 540-2 through the interior volume 540-1 (whereupon it acts to dissolve a chemical tablet therein; not shown) and to the fluid outlet 544. As depicted, the fluid outlet 544 may comprise and/or define a portion of the cylindrically shaped body and/or the interior volume 540-1 that corresponds to the third diameter 540-1*c* (and/or a diameter that is smaller than the first diameter 540-1*a*).

According to some embodiments, the chemical tablet dissolution element 540 may comprise and/or be coupled to a left latch retaining feature 542*a*-1 and/or a right latch retaining feature 542*a*-2. The left and right latch retaining features 542*a*-1, 542*a*-2 may, for example, comprise projections from the cylindrically shaped body that extend from an upper portion of the chemical tablet dissolution element 540. In some embodiments, the left and right latch retaining features 542*a*-1, 542*a*-2 may be shaped and/or configured to couple or mate to and/or receive a latch (not shown in FIG. 5A, FIG. 5B, FIG. 5C, FIG. 5D, FIG. 5E, FIG. 5F, and/or FIG. 5G; e.g., the latch 216 and/or the latch pivot 216-1 of FIG. 2 herein). The left and right latch retaining features 542*a*-1, 542*a*-2 may, for example, comprise and/or define a left pivot pin seat 542*a*-3 and a right pivot pin seat 542*a*-4 that are shaped and/or positioned to accept pivot pins or arms (not shown) of a latch or other mechanism (e.g., a mechanism operable to seal the opening of the first end 540-3). The left and right pivot pin seats 542*a*-3, 542*a*-4 may, for example, be circularly shaped (as shown) to accept a cylindrically shaped pivot pin or arm. In some embodiments, the left and/or right pivot pin seats 542*a*-3, 542*a*-4 may be configured to retain such a pin or arm, such as by providing an interference and/or other coupling fit and/or by latching onto a feature of the pin or arm. As depicted, another element (e.g., a portion of a housing in which the chemical tablet dissolution element 540 is disposed; not shown) may be operationally disposed to cover the left and right pivot pin seats 542*a*-3, 542*a*-4 to prevent disengagement of any retained pin or arm therefrom.

In some embodiments, the chemical tablet dissolution element 540 may comprise and/or be coupled to a left cap retaining feature 542*b*-1 and/or a right cap retaining feature 542*b*-2. The left and right cap retaining features 542*b*-1, 542*b*-2 may, for example, comprise projections from the cylindrically shaped body that extend from a lower portion of the chemical tablet dissolution element 540. In some embodiments, the left and right cap retaining features 542*b*-1, 542*b*-2 may be shaped and/or configured to couple or mate to and/or receive a cap (not shown in FIG. 5A, FIG. 5B, FIG. 5C, FIG. 5D, FIG. 5E, FIG. 5F, and/or FIG. 5G; e.g., the cap 218 and/or the cap pivot 218-1 of FIG. 2 herein). The left and right cap retaining features 542*b*-1, 542*b*-2 may, for example, comprise and/or define a left pin channel 542*b*-3 and a right pin channel 542*b*-4 that are shaped and/or positioned to accept pivot pins or arms (not shown) of a cap or other mechanism (e.g., a mechanism operable to seal the opening of the first end 540-3). The left and right pin channels 542*b*-3, 542*b*-4 may, for example, be shaped as slots having rounded ends to accept a cylindrically shaped pivot pin or arm. In some embodiments, the left and/or right pin channels 542*b*-3, 542*b*-4 may be configured to retain such a pin or arm, such as by providing an interference and/or other coupling fit and/or by latching onto a feature of the pin or arm. As depicted, another element (e.g., a portion of a housing in which the chemical tablet dissolution element 540 is disposed; not shown) may be operationally disposed to cover the ends of the left and right pin channels 542*b*-3, 542*b*-4 to prevent disengagement of any retained pin or arm therefrom.

Figure 6B:
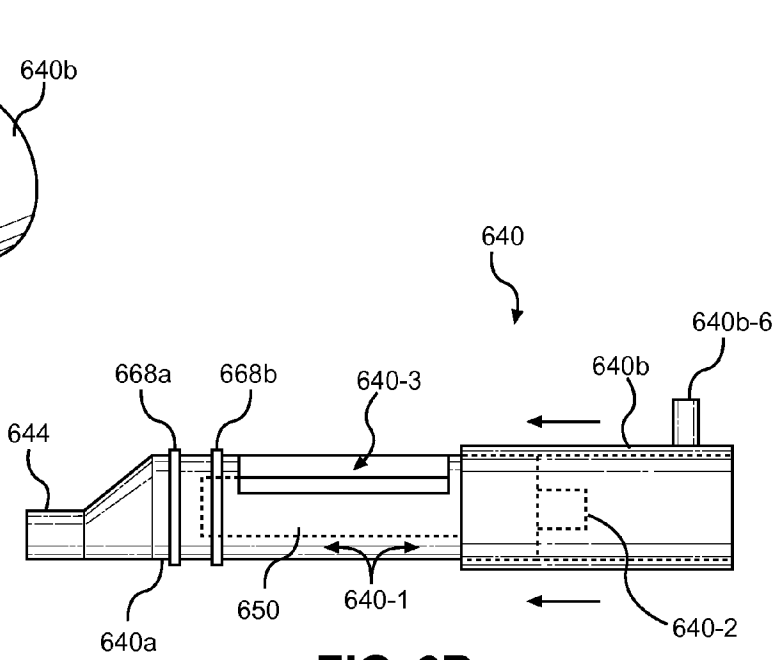
FIG. 6A, FIG. 6B, and FIG. 6C are an upper, front-left perspective view, a left-side view, and a left-side cross section view of a chemical tablet dissolution element according to some embodiments.
Figure 6A:
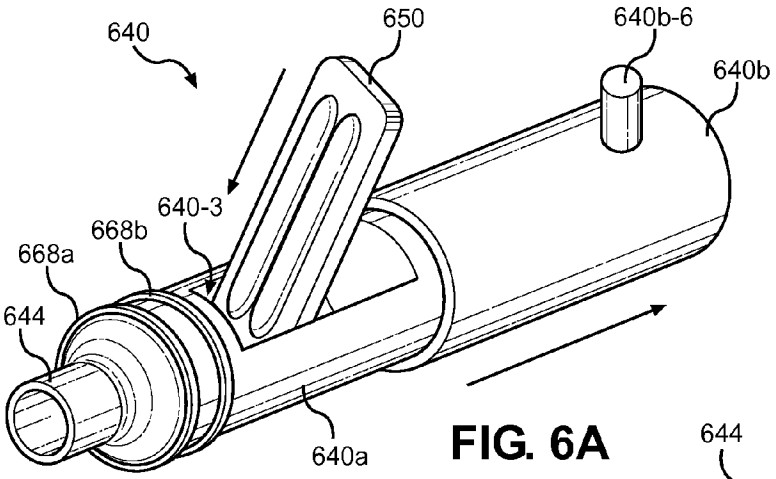
Figure 6C:
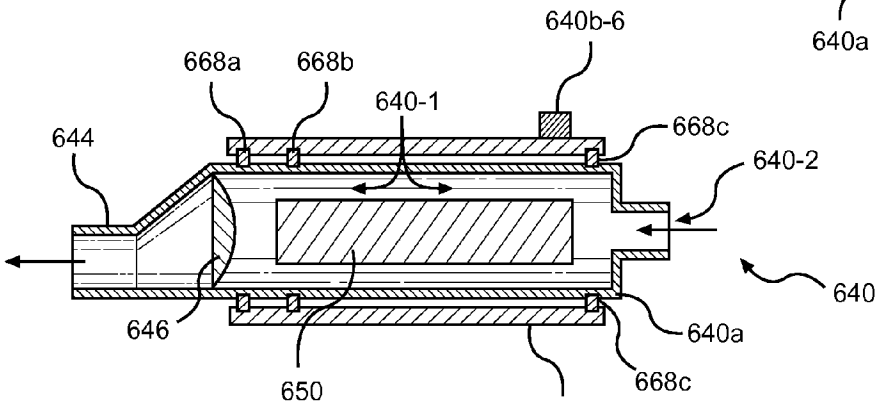

Referring now FIG. 6A, FIG. 6B, and FIG. 6C are an upper, front-left perspective view, a left-side view, and a left-side cross section view of a chemical tablet dissolution element 640 according to some embodiments are shown. In some embodiments, the chemical tablet dissolution element 640 may comprise a cylindrically shaped body 640*a-b* comprising an inner body member 640*a* and an outer body member 640*b*. The inner body member 640*a* may, in some embodiments, define an interior volume 640-1 in communication with a fluid inlet 640-2 at a first end and comprise an opening 640-3 through a portion of the cylindrical wall of the inner body member 640*a*. In some embodiments, the outer body member 640*b* may be slipped over and/or onto the inner body member 640*a*. According to some embodiments, the inner body member 640*a* and/or the opening 640-3 thereof may be selectively shrouded by the outer body member 640*b*. The outer body member 640*b* may, for example, be slidably engaged from a first or open position (as depicted in FIG. 6A and FIG. 6B) in which the opening 640-3 is in communication with the atmosphere to a second or closed position (as depicted in FIG. 6C) to cover the opening 640-3 (e.g., in accordance with the directional movement arrows shown in FIG. 6B). In some embodiments, the outer body member 640*b* may comprise a bolt or handle 640*b*-6 via which transition between the first and second positions may be effectuated.

In some embodiments, the fluid inlet 640-2 may accept incoming pressurized fluid flow from other components and/or elements (not shown) of a hand-held solid chemical applicator and/or portion thereof (not shown in FIG. 6A, FIG. 6B, and FIG. 6C; e.g., the hand-held solid chemical applicator 100, 200, 300 of FIG. 1A, FIG. 1B, FIG. 2, and/or FIG. 3 herein). The fluid may be directed from the fluid inlet 640-2 and through the interior volume 640-1, for example, and/or to a fluid outlet 644 (e.g., at a second end of the inner body member 640*a*). According to some embodiments, a filter 646 may be disposed in the interior volume 640-1 such that fluid passing from the fluid inlet 640-2 to the fluid outlet 644 passes through and/or is filtered by the filter 646. The filter 646 may prevent, for example, particulates over a certain designed filter mesh size from existing the chemical tablet dissolution element 640. In some embodiments for example, a solid chemical tablet 650 may be inserted into and/or disposed within the interior volume 640-1 of the inner body member 640*a*. Fluid flow through the chemical tablet dissolution element 640 may dissolve the solid chemical tablet 650 and the filter 646 may prevent larger portions of the chemical tablet 650 from exiting the interior volume 640-1 prior to desired dissolution thereof (e.g., prior to reduction of the chemical tablet portions to a designed particulate size).

According to some embodiments, the solid chemical tablet 650 may be inserted into the inner body member 640*a* (e.g., the interior volume 640-1 thereof) in the case that the outer body member 640*b* is selectively engaged in the first or open position (as depicted in FIG. 6A and FIG. 6B). The outer body member 640*b* may be forcibly engaged by applying a sliding force thereto, for example, causing a sliding (e.g., in accordance with the directional movement arrow shown in FIG. 6A) of the outer body member 640*b* toward the first end of the inner body member (e.g., toward the fluid inlet 640-2) which causes an opening or uncovering of the opening 640-3, revealing the interior volume 640-1. The solid chemical tablet 650 may then be inserted through the opening 640-3 and into the interior volume 640-1, e.g., in accordance with the directional movement arrow shown in FIG. 6A). The outer body member 640*b* may then be reversibly slidably engaged by applying a reverse sliding force thereto, causing a sliding (e.g., in accordance with the directional movement arrows shown in FIG. 6B) of the outer body member 640*b* toward the second end of the inner body member (e.g., toward the fluid outlet 644) which causes a closing or covering of the opening 640-3, e.g., sealing the interior volume 640-1. In some embodiments, one or more O-rings or seals 668*a-c* may be utilized to provide a fluid-tight sealing between the inner body member 640*a* and the outer body member 640*b*.

Figure 7:
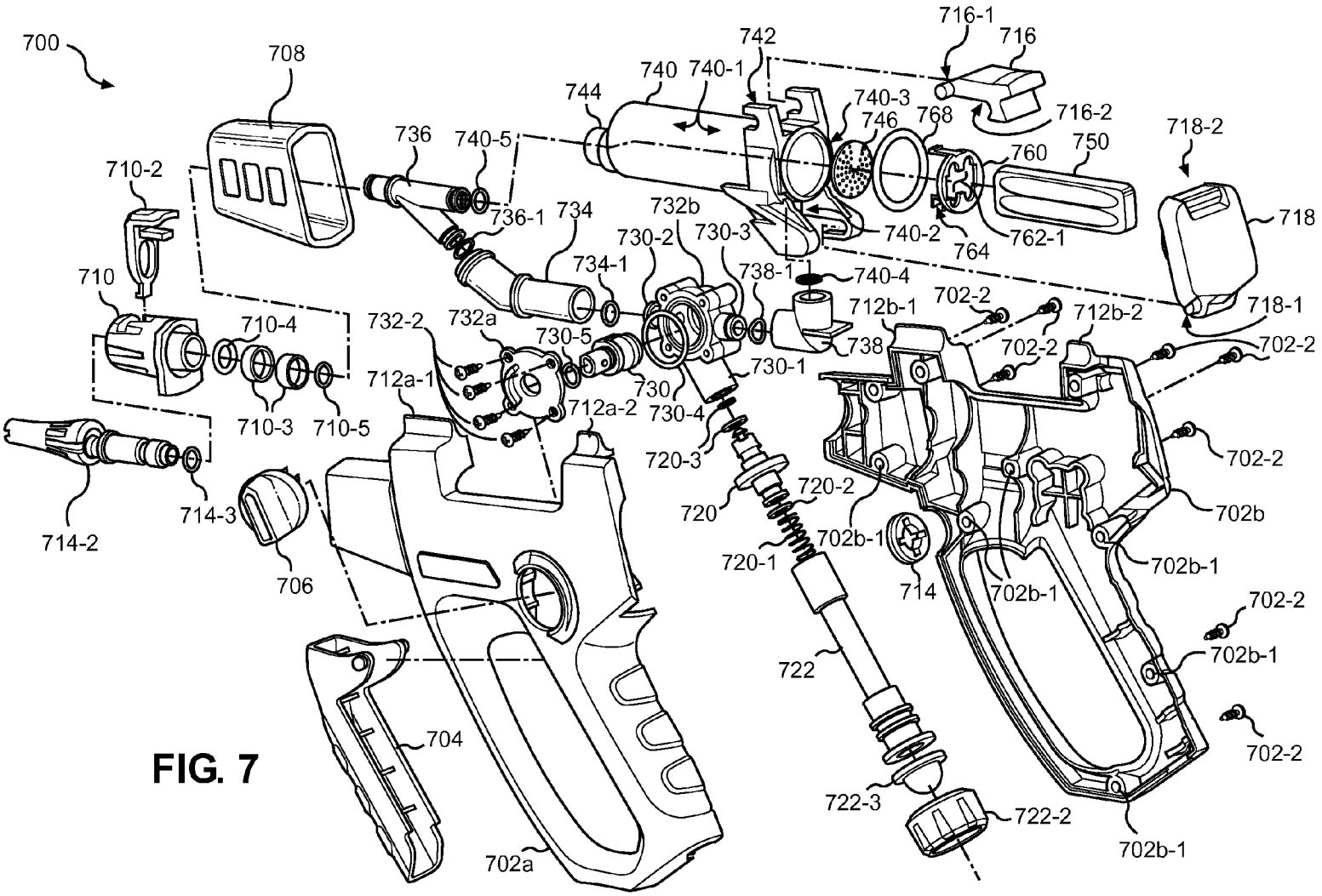
FIG. 7 is an upper, right-rear perspective assembly view of a hand-held solid chemical applicator assembly according to some embodiments.

Referring now to FIG. 7, an upper, right-rear perspective assembly view of a hand-held solid chemical applicator assembly 700 according to some embodiments is shown. In some embodiments, the hand-held solid chemical applicator assembly 700 may be similar in configuration and/or functionality to the hand-held solid chemical applicator assemblies 100, 200, 300 of FIG. 1A, FIG. 1B, FIG. 2, and/or FIG. 3 herein. In some embodiments, the hand-held solid chemical applicator assembly 700 may comprise a housing 702*a-b* comprising a left-side shell portion 702*a* and a right-side shell portion 702*b* joined together at various coupling locations 702*b*-1 (those of the right-side shell portion 702*b* being visible in FIG. 7) by a plurality of screws 702-2. In some embodiments, the housing 702*a-b* may be coupled to a trigger valve actuator 704, a mixing valve actuator 706, a nose piece 708, and/or a fluid outlet 710. In some embodiments, an extension wand retaining clip 710-2 may e.g. be provided to removably store an extension wand (not shown). In some embodiments, the fluid outlet 710 may house, comprise, and/or couple to a wand retainer 710-3 and/or a first wand retaining seal (e.g., O-ring) 710-4 and a second wand retaining seal (e.g., O-ring) 710-5, such that the extension wand may be coupled to accept fluid flow from the fluid outlet 710 in a water-tight manner. In some embodiments, the housing 702*a-b* may be configured to retain the extension wand in cooperation with the extension wand retaining clip 710-2. The left-side shell portion 702*a* may comprise a left forward wand channel portion 712*a*-1 and/or a left rear wand channel portion 712*a*-2, each of which may be respectively mated with a right forward wand channel portion 712*b*-1 and a right rear wand channel portion 712*b*-2 of the right-side shell portion 702*b*, e.g., to collectively form a wand channel in which the extension wand (or a portion thereof) may be selectively retained by the extension wand retaining clip 710-2.

According to some embodiments, a grommet 714 may removably engaged with and/or store an extension nozzle 714-2. The extension nozzle 714-2 may optionally be disengaged from the grommet 714 and removably coupled to the fluid outlet 710, e.g., employing a nozzle seal (e.g., an O-ring) 714-3 to provide a water-tight seal for fluid flowing through the fluid outlet 710 and into the extension nozzle 714-2. In some embodiments, the hand-held solid chemical applicator assembly 700 may comprise a latch 716 pivotally coupled, in some embodiments, to the housing 702*a-b*. In some embodiments, the latch 716 may comprise a latch hinge portion 716-1 and/or a latch feature 716-2. According to some embodiments, the hand-held solid chemical applicator assembly 700 may comprise a cap 718 pivotally coupled, in some embodiments, to the housing 702*a-b*. The cap 718 may comprise, in some embodiments, a cap hinge portion 718-1 and/or a catch feature 718-2. Each of the hinged portions 716-1, 718-1 may be selectively and rotatably engaged, for example, to selectively engage the latch feature 716-2 with the catch feature 718-2, such that the latch 716 and the cap 718 are selectively mated and subsequently uncoupled.

In some embodiments, the hand-held solid chemical applicator assembly 700 may comprise an axial, plunger, or trigger-style flow valve 720 that comprises and/or is coupled to or mated with a valve spring 720-1, a first flow valve seal (e.g., a first O-ring) 720-2, and/or one or more second flow valve seals (e.g., a second O-ring) 720-3. According to some embodiments, the flow valve 720 may be coupled to receive pressurized fluid flow from a fluid inlet 722. The trigger valve actuator 704 may be coupled to engage with the trigger-style flow valve 720, via the valve spring 720-1 for example, providing for regulated and/or varying pressurized flow into and/or through the hand-held solid chemical applicator assembly 700. In some embodiments, a threaded coupler 722-2 and/or a screen 722-3 may be provided to interface with the pressurized flow and/or the source thereof (not shown). In some embodiments, a mixing valve 730 may be disposed within a mixing valve housing 732*a-b* comprising a left-side housing member 732*a* and a right-side housing member 732*b*. In some embodiments, the mixing valve housing 732*a-b* may define a mixing valve inlet 730-1, a rinse outlet 730-2, and/or a mixing outlet 730-3. In some embodiments, the left-side housing member 732*a* and the right-side housing member 732*b* may be coupled utilizing a plurality of screws 732-2. According to some embodiments, a mixing valve seal (e.g., O-ring) 730-4 may be coupled between the left-side housing member 732*a* and the right-side housing member 732*b* to provide a water-tight seal for the mixing valve 730.

According to some embodiments, the mixing valve 730 may be operable to be rotationally engaged with the mixing valve actuator 706 (e.g., utilizing a mixing valve knob seal (e.g., O-ring) 730-5 to provide a water-tight seal for the mixing valve 730) to distribute pressurized flow (as regulated and/or provided by the trigger-style flow valve 720) to various components. In some embodiments, for example, the rinse outlet 730-2 of the mixing valve 730 may selectively and/or variably provide and/or distribute pressurized flow to (i) a first fluid conduit 734 (e.g., utilizing a first fluid conduit seal (e.g., O-ring) 734-1 to provide a water-tight seal) coupled to deliver pressurized flow to a mixing conduit 736 (e.g., utilizing a mixing conduit seal (e.g., O-ring) 736-1 to provide a water-tight seal) and/or (ii) a second fluid conduit 738 (e.g., utilizing a second fluid conduit seal (e.g., O-ring) 738-1 to provide a water-tight seal) coupled to deliver pressurized flow into a solid chemical tablet chamber 740.

In some embodiments, the solid chemical tablet chamber 740 may define an interior volume 740-1 into which an inlet orifice 740-2 provides pressurized flow from the second fluid conduit 738 (e.g., utilizing inlet conduit seal (e.g., O-ring) 740-4 to provide a water-tight seal). According to some embodiments, the inlet orifice 740-2 may be disposed and/or formed in a side-wall of the solid chemical tablet chamber 740 near an open end 740-3 thereof which is, e.g., optionally closed and/or opened by engagement with the cap 718 and/or latch 716. According to some embodiments, fluid received via the inlet orifice 740-2 may be transmitted through the interior volume 740-1 and to outlet orifice 744 (e.g., optionally through a screen 746) that is coupled to deliver the fluid flow to the mixing conduit 736 (e.g., utilizing an outlet orifice seal (e.g., O-ring) 740-5 to provide a water-tight seal). The mixing conduit 736 may, for example, receive pressurized flow from each of the first fluid conduit 734 and the outlet orifice 744 of the solid chemical tablet chamber 740, thereby mixing the flows from both sources, and may provide the mixed pressurized flow through the fluid outlet 710. In the case that a chemical tablet 750 is disposed in the solid chemical tablet chamber 740 and dissolved by the pressurized flow therein, the mixing conduit 736 may accordingly mix each of a standard fluid flow from the first fluid conduit 734 and a chemical-fluid flow from the outlet orifice 744 of the solid chemical tablet chamber 740. In such a manner, for example, a mixed or combined flow comprising and/or defining a chemical cleaning solution may be applied via the fluid outlet 710.

In some embodiments, the latch 716 (and/or the latch hinge feature 716-1 thereof) and/or the cap 718 (and/or the cap hinge feature 718-1 thereof) may be pivotally coupled to opposite sides of the open end 740-3 of the solid chemical tablet chamber 740 such as by being coupled to a mounting portion 742 of the solid chemical tablet chamber 740. According to some embodiments, an orifice device 760 may be coupled to the open end 740-3 of the solid chemical tablet chamber 740, restricting and/or governing insertion of the chemical tablet 750. The orifice device 760 may be coupled, for example, to the open end 740-3 of the solid chemical tablet chamber 740 between the solid chemical tablet chamber 740 and the cap 718. According to some embodiments, a chamber seal (e.g., O-ring) 768 may be disposed between the solid chemical tablet chamber 740 and the cap 718 to provide for a water-tight seal there between. In some embodiments, the orifice device 760 may define a shaped tablet orifice 762-1 through which a similarly-shaped chemical tablet 750 may be inserted into the interior volume 740-1 (e.g., in the case that the cap 718 is open). According to some embodiments, the orifice device 760 may comprise (and/or be coupled to) a flow diverter 764 that, upon assembly of the hand-held solid chemical applicator assembly 700 is disposed and/or coupled to direct (or redirect) pressurized flow that enters the interior volume 740-1 via the inlet orifice 740-2. As depicted in FIG. 7, the solid chemical tablet chamber 740 may, in some embodiments, be constructed of transparent or translucent material (such as clear plastic) such that a state of dissolution of the chemical tablet 750 may be monitored by an operator during use of the hand-held solid chemical applicator assembly 700.

According to some embodiments, any or all of the components 702*a-b*, 702*b*-1, 702-2, 704, 706, 708, 710, 710-2, 710-3, 710-4, 710-5, 712*a*-1, 712*a*-2, 712*b*-1, 712*b*-2, 714, 714-2, 714-3, 716, 716-1, 716-2, 718, 718-1, 718-2, 720, 720-1, 720-2, 720-3, 722, 722-2, 722-3, 730, 730-1, 730-2, 730-3, 730-4, 730-5, 732*a-b*, 732-2, 734, 734-1, 736, 736-1, 738, 738-1, 740, 740-1, 740-2, 740-3, 740-4, 740-5, 742, 744, 746, 750, 760, 762-1, 764, 768 of the hand-held solid chemical applicator assembly 500 may be similar in configuration and/or functionality to any similarly named and/or numbered components described herein. Fewer or more components 702*a-b*, 702*b*-1, 702-2, 704, 706, 708, 710, 710-2, 710-3, 710-4, 710-5, 712*a*-1, 712*a*-2, 712*b*-1, 712*b*-2, 714, 714-2, 714-3, 716, 716-1, 716-2, 718, 718-1, 718-2, 720, 720-1, 720-2, 720-3, 722, 722-2, 722-3, 730, 730-1, 730-2, 730-3, 730-4, 730-5, 732*a-b*, 732-2, 734, 734-1, 736, 736-1, 738, 738-1, 740, 740-1, 740-2, 740-3, 740-4, 740-5, 742, 744, 746, 750, 760, 762-1, 764, 768 (and/or portions thereof) and/or various configurations of the components 702*a-b*, 702*b*-1, 702-2, 704, 706, 708, 710, 710-2, 710-3, 710-4, 710-5, 712*a*-1, 712*a*-2, 712*b*-1, 712*b*-2, 714, 714-2, 714-3, 716, 716-1, 716-2, 718, 718-1, 718-2, 720, 720-1, 720-2, 720-3, 722, 722-2, 722-3, 730, 730-1, 730-2, 730-3, 730-4, 730-5, 732*a-b*, 732-2, 734, 734-1, 736, 736-1, 738, 738-1, 740, 740-1, 740-2, 740-3, 740-4, 740-5, 742, 744, 746, 750, 760, 762-1, 764, 768 may be included in the hand-held solid chemical applicator assembly 500 without deviating from the scope of embodiments described herein. In some embodiments, one or more of the various components 702*a-b*, 702*b*-1, 702-2, 704, 706, 708, 710, 710-2, 710-3, 710-4, 710-5, 712*a*-1, 712*a*-2, 712*b*-1, 712*b*-2, 714,

714-2, 714-3, 716, 716-1, 716-2, 718, 718-1, 718-2, 720, 720-1, 720-2, 720-3, 722, 722-2, 722-3, 730, 730-1, 730-2, 730-3, 730-4, 730-5, 732*a-b*, 732-2, 734, 734-1, 736, 736-1, 738, 738-1, 740, 740-1, 740-2, 740-3, 740-4, 740-5, 742, 744, 746, 750, 760, 762-1, 764, 768 may not be needed and/or desired in the hand-held solid chemical applicator assembly 500.

III. Conclusion

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicant(s) reserves the right to file additional applications to pursue patents for subject matter that has been disclosed and enabled, but not claimed in the present application.

What is claimed is:

1. A hand-held solid chemical applicator for cleaning heat exchange coils, comprising:

a fluid inlet disposed in a handle portion of the hand-held solid chemical applicator;

a first valve coupled to the fluid inlet;

a second valve comprising a selectively variable valve coupled to at least one of (i) the fluid inlet and (ii) the first valve;

a fluid outlet in communication with the second valve;

a chemical chamber inlet in communication with the second valve;

a chemical chamber comprising a first open end and a second end opposite the first end, the chemical chamber being in communication with the chemical chamber inlet and the fluid outlet, the chemical chamber inlet being disposed near the first open end, the chemical chamber being disposed in a body portion of the hand-held solid chemical applicator, and the chemical chamber being operable to receive a chemical tablet; and a flow diverter disposed inside of the chemical chamber and oriented to deflect the fluid flow received from the chemical chamber inlet.

2. The hand-held solid chemical applicator of claim 1, wherein the chemical chamber comprises a cylindrical chamber, the fluid from the chemical chamber inlet is received from a radius of the cylindrical chamber, and the flow diverter comprises an angled element disposed to deflect the received fluid flow from a radial direction to a direction along the interior circumference of the cylindrical chamber.

3. The hand-held solid chemical applicator of claim 1, further comprising:

a hinged cap coupled to the first open end of the chemical chamber.

4. The hand-held solid chemical applicator of claim 3, further comprising:

a hinged latch coupled to selectively engage with the hinged cap to secure the hinged cap in closed position sealing the first open end of the chemical chamber.

5. The hand-held solid chemical applicator of claim 4, wherein the hinged cap is hinged at a first position with respect to the first open end of the chemical chamber and the hinged latch is hinged at a second position with respect to the first open end of the chemical chamber, the first and second positions comprising opposite positions.

6. The hand-held solid chemical applicator of claim 1, wherein the handle portion of the hand-held solid chemical applicator is oriented along a first axis and wherein the body portion of the hand-held solid chemical applicator is disposed along a second axis, the first axis and the second axis being oriented at an angle to each other.

7. The hand-held solid chemical applicator of claim 6, wherein the angle is defined as the angle between the direction of fluid flow from the fluid inlet along the first axis and the second axis at the open first end of the chemical chamber, and wherein the angle comprises an acute angle.

8. The hand-held solid chemical applicator of claim 6, wherein the first axis is vertically-oriented and the second axis is horizontally-oriented.

9. The hand-held solid chemical applicator of claim 1, wherein the chemical chamber comprises a transparent cylindrical chamber, the hand-held solid chemical applicator further comprising:

an orifice partition coupled to the first end of the chemical chamber, the orifice partition defining a non-cylindrically shaped chemical tablet insertion orifice through which non-cylindrically shaped chemical tablets may be inserted into the cylindrical chamber.

10. The hand-held solid chemical applicator of claim 9, wherein the non-cylindrically shaped chemical tablet insertion orifice defines an hourglass-shaped opening.

11. A hand-held solid chemical applicator for cleaning heat exchange coils, comprising:

a fluid inlet disposed in a handle portion of the hand-held solid chemical applicator, the handle portion being oriented along a first axis;

a first valve coupled to the fluid inlet;

a second valve comprising a selectively variable valve coupled to at least one of (i) the fluid inlet and (ii) the first valve, wherein the second valve selectively distributes variable portions of the fluid into a fluid outlet and a chemical chamber inlet;

a chemical chamber comprising a first open end and a second end opposite the first end, the chemical chamber comprising a cylindrical chamber being coupled to the chemical chamber inlet and to the fluid outlet, the chemical chamber inlet being disposed near the first open end, the chemical chamber being disposed in a body portion of the hand-held solid chemical applicator, the body portion and the chemical chamber being oriented along a second axis disposed at an angle to the first axis, wherein the direction of fluid flow into the cylindrical chamber from the chemical chamber inlet comprises flow in an inward radial direction, and the chemical chamber being operable to receive a chemical tablet, wherein the angle, measured between the direction of fluid flow from the fluid inlet along the first axis and the second axis at the open first end of the chemical chamber, is less than or equal to ninety degrees (90°); and a flow diverter disposed inside of the cylindrical chamber and oriented to deflect the fluid flow received from the chemical chamber inlet from the inward radial direction to a circumferential direction along an inside wall of the cylindrical chamber.

12. The hand-held solid chemical applicator of claim 11, wherein the angle is in the range of thirty-five degrees (35°) to fifty-five degrees (55°).

13. The hand-held solid chemical applicator of claim 11, wherein the first axis is vertically-oriented and the second axis is horizontally-oriented.

14. The hand-held solid chemical applicator of claim 11, wherein the chemical chamber inlet is disposed to direct the fluid flow into the chemical chamber in a direction normal to the second axis.

15. A hand-held solid chemical applicator for cleaning heat exchange coils, comprising:

a fluid inlet oriented along a first axis;

a fluid outlet oriented along a second axis;

a first valve coupled to the fluid inlet, the first valve operable to govern flow of a fluid through the fluid inlet;

a second valve comprising a selectively variable valve coupled to at least one of the fluid inlet and the first valve, the second valve operable to receive the fluid from at least one of (i) the fluid inlet and (ii) the first valve, and the second valve being in communication with the fluid outlet and a chemical chamber inlet, the second valve being selectively operable to distribute variable portions of the fluid into the fluid outlet and the chemical chamber inlet;

a chemical chamber comprising a first open end and a second end opposite the first end, the chemical chamber being coupled to the chemical chamber inlet and operable to receive fluid from the chemical chamber inlet and the chemical chamber being in communication with the fluid outlet and operable to direct the received fluid to the fluid outlet, the chemical chamber inlet being disposed near the first open end, the chemical chamber being oriented along the second axis, and the chemical chamber being operable to receive a chemical tablet; and a flow diverter disposed inside of the chemical chamber and oriented to deflect the fluid flow received from the chemical chamber inlet.

16. The hand-held solid chemical applicator of claim 15, wherein the chemical chamber comprises a transparent cylindrical chamber, the hand-held solid chemical applicator further comprising:

an orifice partition coupled to the first end of the chemical chamber, the orifice partition defining a non-cylindrically shaped chemical tablet insertion orifice through which non-cylindrically shaped chemical tablets may be inserted into the cylindrical chamber.

17. The hand-held cleaning solution delivery mechanism of claim 16, wherein the non-cylindrically shaped chemical tablet insertion orifice defines an hourglass-shaped opening.

* * * * *